US009427638B2

(12) United States Patent
Sanyal et al.

(10) Patent No.: US 9,427,638 B2
(45) **Date of Patent: *Aug. 30, 2016**

(54) GOLF CLUB CONFIGURED FOR MULTIPLE ADJUSTABILITY

(71) Applicant: Brainstorm Golf, Inc., Escondido, CA (US)

(72) Inventors: Vikash Sanyal, Valley Center, CA (US); David Stuart Cooper, Jr., Encinitas, CA (US); Jeffrey D. Sheets, Buda, TX (US)

(73) Assignee: Brainstorm Golf, Inc.

( * ) Notice: Subject to any disclaimer, the term of this patent is extended or adjusted under 35 U.S.C. 154(b) by 0 days.

This patent is subject to a terminal disclaimer.

(21) Appl. No.: 14/216,973

(22) Filed: Mar. 17, 2014

(65) Prior Publication Data

US 2014/0378243 A1 Dec. 25, 2014

Related U.S. Application Data

(60) Provisional application No. 61/799,513, filed on Mar. 15, 2013.

(51) Int. Cl.
*A63B 53/02* (2015.01)
*A63B 53/06* (2015.01)
(Continued)

(52) U.S. Cl.
CPC ..... *A63B 53/065* (2013.01); *A63B 53/007* (2013.01); *A63B 53/02* (2013.01); *A63B 53/0487* (2013.01); *A63B 60/52* (2015.10); *A63B 2053/022* (2013.01); *A63B 2053/025* (2013.01); *A63B 2053/026* (2013.01); *A63B 2053/0416* (2013.01); *A63B 2053/0437* (2013.01); *A63B 2053/0441* (2013.01); *A63B 2053/0491* (2013.01)

(58) Field of Classification Search
CPC ..... A63B 53/065; A63B 53/02; A63B 2053/026; A63B 2053/025; A63B 2053/0491; A63B 49/06; A63B 53/007; A63B 53/0487; A63B 2053/0441; A63B 2053/022; A63B 2053/0437; A63B 2053/0416; A63B 60/52
See application file for complete search history.

(56) References Cited

U.S. PATENT DOCUMENTS 3,423,089 A 1/1969 Andis
4,111,426 A 9/1978 Goodwin
(Continued)

FOREIGN PATENT DOCUMENTS

WO WO95/30455 11/1995

OTHER PUBLICATIONS

PCT/US2014/030338, ISR and Written Opinion dated Sep. 22, 2014.
(Continued)

*Primary Examiner* — Stephen Blau
(74) *Attorney, Agent, or Firm* — Cooley LLP

(57) ABSTRACT

In some embodiments, an adjustable putter includes a club body defining a substantially planar face for striking a golf ball, and a hosel including a hosel neck and a hosel adapter configured to be received within a hosel chamber defined by the club body. The hosel adapter defines an interior channel. The adjustable putter also includes a shaft attachable to the hosel neck, and a housing column. The hosel adapter is configured to rotate about the housing column so as to adjust a lie angle of the hosel neck, and the hosel chamber is configured to prevent rotation of the hosel adapter from increasing the lie angle beyond a predetermined value.

27 Claims, 27 Drawing Sheets

(51) Int. Cl.
*A63B 53/00* (2015.01)
*A63B 53/04* (2015.01)

(56) References Cited

U.S. PATENT DOCUMENTS

| | | | | |
|---|---|---|---|---|
| 4,194,739 | A | 3/1980 | Thompson | |
| 4,291,883 | A | 9/1981 | Smart et al. | |
| 4,506,888 | A | 3/1985 | Nardozzi, Jr. | |
| 4,519,612 | A | 5/1985 | Tsao | |
| 5,308,063 | A | 5/1994 | Vendur | |
| 5,390,918 | A | 2/1995 | Meyers et al. | |
| 5,390,919 | A | 2/1995 | Stubbs et al. | |
| 5,407,196 | A | 4/1995 | Busnardo | |
| 5,415,399 | A | 5/1995 | Kettelson | |
| 5,429,356 | A | 7/1995 | Dingle et al. | |
| 5,437,447 | A * | 8/1995 | Rigutto | A63B 53/0487 473/251 |
| 5,441,274 | A | 8/1995 | Clay | |
| 5,470,063 | A | 11/1995 | Fisher | |
| 5,511,779 | A | 4/1996 | Meyers et al. | |
| 5,533,730 | A | 7/1996 | Ruvang | |
| 5,577,726 | A | 11/1996 | Fenton | |
| 5,580,051 | A | 12/1996 | Fisher | |
| 5,597,362 | A | 1/1997 | Lee et al. | |
| 5,692,969 | A | 12/1997 | Schooler | |
| 5,716,287 | A | 2/1998 | Levocz et al. | |
| 5,746,664 | A | 5/1998 | Reynolds, Jr. | |
| 5,749,790 | A | 5/1998 | Van Allen, II et al. | |
| 5,803,824 | A | 9/1998 | Rollingson | |
| 5,816,931 | A | 10/1998 | Schooler | |
| 5,863,257 | A | 1/1999 | Busnardo | |
| 5,924,938 | A * | 7/1999 | Hines | A63B 53/02 473/307 |
| 5,993,324 | A | 11/1999 | Gammil | |
| 6,001,024 | A | 12/1999 | Van Alen, II et al. | |
| 6,056,647 | A | 5/2000 | Tingelstad | |
| 6,095,929 | A * | 8/2000 | Clark | A63B 53/02 473/248 |
| 6,126,555 | A | 10/2000 | Schooler | |
| 6,142,884 | A | 11/2000 | Yim | |
| 6,348,014 | B1 | 2/2002 | Chiu | |
| 6,435,976 | B1 | 8/2002 | Galliers | |
| 6,558,269 | B1 | 5/2003 | McBee | |
| 6,616,545 | B2 | 9/2003 | Lacoste | |
| 6,623,372 | B1 | 9/2003 | Beebe et al. | |
| 6,663,497 | B2 | 12/2003 | Cameron | |
| 6,723,000 | B1 | 4/2004 | Dombrowski | |
| 6,875,123 | B2 | 4/2005 | Wilson | |
| 6,991,555 | B2 | 1/2006 | Reese | |
| 7,004,849 | B2 | 2/2006 | Cameron | |
| 7,052,410 | B2 | 5/2006 | Cameron | |
| 7,070,515 | B1 * | 7/2006 | Liu | 473/340 |
| 7,316,622 | B1 * | 1/2008 | Lucas | 473/239 |
| 7,335,112 | B1 | 2/2008 | Bitondo | |
| 7,442,129 | B2 | 10/2008 | Bardha | |
| 7,563,172 | B2 | 7/2009 | Mansfield | |
| 7,645,199 | B2 | 1/2010 | Cameron | |
| 7,762,115 | B2 | 7/2010 | Fife, Jr. et al. | |
| 7,891,105 | B2 | 2/2011 | Kramski | |
| 7,905,792 | B1 | 3/2011 | Stites et al. | |
| 7,993,211 | B2 | 8/2011 | Bardha | |
| 8,075,416 | B2 | 12/2011 | Stites et al. | |
| 8,162,774 | B2 * | 4/2012 | Sato et al. | 473/307 |
| 8,177,663 | B2 | 5/2012 | Tucker, Sr. et al. | |
| 8,235,834 | B2 | 8/2012 | De La Cruz et al. | |
| 8,246,484 | B2 * | 8/2012 | Sato et al. | 473/307 |
| 8,382,604 | B2 | 2/2013 | Billings | |
| RE44,598 | E | 11/2013 | Prince | |
| 8,579,716 | B1 | 11/2013 | Eckhart | |
| 8,632,417 | B2 * | 1/2014 | Sander et al. | 473/307 |
| 8,636,607 | B2 | 1/2014 | Renna | |
| 2002/0115498 | A1 | 8/2002 | Galliers | |
| 2002/0142860 | A1 | 10/2002 | Klyve | |
| 2003/0114240 | A1 | 6/2003 | Lacoste | |
| 2003/0186755 | A1 | 10/2003 | Kitabayashi | |
| 2003/0195053 | A1 | 10/2003 | Cameron | |
| 2004/0063516 | A1 | 4/2004 | Cameron | |
| 2004/0198529 | A1 | 10/2004 | Moore | |
| 2005/0003902 | A1 | 1/2005 | Reese | |
| 2005/0221908 | A1 | 10/2005 | Gornall | |
| 2005/0233821 | A1 | 10/2005 | Dombrowski | |
| 2006/0094535 | A1 | 5/2006 | Cameron | |
| 2006/0135279 | A1 | 6/2006 | Sandino | |
| 2006/0264264 | A1 | 11/2006 | Sandino | |
| 2007/0184915 | A1 | 8/2007 | Mansfield | |
| 2007/0298904 | A1 | 12/2007 | Dworzan | |
| 2008/0009360 | A1 | 1/2008 | Purtill | |
| 2008/0146372 | A1 | 6/2008 | John | |
| 2010/0083518 | A1 | 4/2010 | Kramski | |
| 2010/0197424 | A1 * | 8/2010 | Beach et al. | 473/307 |
| 2011/0021287 | A1 | 1/2011 | Tucker, Sr. et al. | |
| 2011/0209516 | A1 | 9/2011 | Timmons et al. | |
| 2011/0306438 | A1 | 12/2011 | Moore | |
| 2012/0214617 | A1 | 8/2012 | Sato et al. | |
| 2012/0231896 | A1 | 9/2012 | Seluga et al. | |
| 2013/0053166 | A1 | 2/2013 | Tobian | |
| 2013/0325657 | A1 | 12/2013 | Arluna et al. | |
| 2014/0024473 | A1 | 1/2014 | Reid | |
| 2015/0080143 | A1 | 3/2015 | Sanyal et al. | |

OTHER PUBLICATIONS

PCT/US2014/030332, ISR and Written Opinion dated Oct. 1, 2014.
Office Action for U.S. Appl. No. 14/216,979, mailed Sep. 30, 2015, 8 pages.

* cited by examiner

GOLF CLUB CONFIGURED FOR MULTIPLE ADJUSTABILITY

CROSS-REFERENCE TO RELATED APPLICATIONS

This application claims priority to and the benefit of U.S. Provisional Patent Application No. 61/799,513, entitled "Golf Club Configured for Multiple Adjustability," filed Mar. 15, 2013, the disclosure of which is incorporated herein by reference in its entirety. This application is also related to pending U.S. patent application Ser. No. 14/216,979, entitled "Adjustable Golf Club", filed on Mar. 17, 2014.

BACKGROUND

The systems and methods of the disclosure relate to relate to adjustable golf clubs. In particular, but not by way of limitation, the present disclosure relates to adjustable putters that are configured to be adapted to vary one or more features including an adjustable lie angle of a hosel neck, an adjustable offset distance of a shaft relative to a face of the putter, and a loft angle of the face.

Each individual golfer is different, being of differing strength, differing size, and having different golf club strokes. Modern golf clubs are fitted to match a golfer's strength, size and type of stroke. However, custom fitting of golf clubs can be extremely expensive.

Some golf clubs have been designed with some adaptability. However, these adaptable golf clubs can be very complex to build and often require dozens if not hundreds of different sized components. As a result, these adaptable golf clubs can also be extremely expensive.

Although present golf clubs are functional and can be fitted to a specific golfer or adapted in some ways to be customizable for different golfers, they are not sufficiently adaptable, affordable or otherwise satisfactory. Accordingly, an adjustable putter is needed to address the shortfalls of present technology and to provide other new and innovative features.

SUMMARY

Exemplary embodiments of the teachings disclosed herein are shown in the drawings that are summarized below. These and other embodiments are more fully described in the Detailed Description section. It is to be understood, however, that there is no intention to limit the invention to the forms described in this Summary or in the Detailed Description. One skilled in the art can recognize that there are numerous modifications, equivalents and alternative constructions that fall within the spirit and scope of the disclosed teachings as expressed in the claims.

In one aspect in accordance with the disclosure, an adjustable putter includes a club body defining a substantially planar face for striking a golf ball and a hosel including a hosel neck and a hosel adapter configured to be received within a hosel chamber defined by the club body wherein the hosel adapter defines an interior channel. The adjustable putter also includes a shaft attachable to the hosel neck, and a housing column. The hosel adapter is configured to rotate about the housing column so as to adjust a lie angle of the hosel neck and the hosel chamber is configured to prevent rotation of the hosel adapter from increasing the lie angle beyond a predetermined value.

In another aspect in accordance with the disclosure, an adjustable golf club head includes a hosel comprising a hosel neck, and a hosel adapter coupled to the hosel neck, the hosel adapter defining an interior channel. The adjustable golf club head further includes a club body comprising a heel portion, a toe portion opposite the heel portion, a sole portion connecting the toe and heel portions and a hosel housing coupled to an upper surface of the sole portion, the hosel housing defining a hosel chamber configured to accept the hosel adapter, the hosel housing further defining a housing face on a front side of the hosel housing. The club body further comprises a housing column coupled to a back side of the housing face, the housing column at least partially contained within the hosel chamber, the housing column being configured to be accepted into the interior channel of the hosel adapter to couple the hosel and the club body. The hosel adapter is configured to rotate about the housing column to adjust a lie angle of the hosel neck and the hosel housing is configured to prevent rotation the hosel adapter to keep the lie angle of the hosel neck below a maximum value.

In another aspect in accordance with the disclosure, an adjustable putter includes a club body defining a substantially planar face for striking a golf ball, a hosel including a hosel adapter configured to be received within a hosel chamber defined by the club body, and a shaft attachable to the hosel. The adjustable putter further includes at least one bushing being receivable within the hosel chamber. An offset distance of the shaft relative to the face is adjusted by changing relative positions of the hosel adapter and the at least one bushing along an axis substantially perpendicular to a plane parallel to a plane of the planar face.

In another aspect in accordance with the disclosure, an adjustable golf club head includes a hosel including a hosel neck, and a hosel adapter coupled to the hosel neck, the hosel adapter defining an interior channel. The adjustable golf club head further comprises a club body and at least one bushing, the at least one bushing defining an interior channel. The club body includes a heel portion, a toe portion opposite the heel portion, a sole portion connecting the toe and heel portions, and a hosel housing coupled to an upper surface of the sole portion, the hosel housing defining a hosel chamber configured to accept the hosel adapter and the at least one bushing, the hosel housing further defining a housing face on a front side of the hosel housing. The club body further comprises a housing column coupled to a back side of the housing face, the housing column at least partially contained within the hosel chamber, the housing column being configured to be accepted into the interior channels of the hosel adapter and the at least one bushing to couple the hosel, the at least one bushing and the club body. Relative positions, of the at least one bushing and the hosel adapter on the housing column are reconfigurable to adjust an offset of the hosel relative to the housing face.

In another aspect in accordance with the disclosure, an adjustable golf club head, includes a face unit defining a substantially planar face for striking a golf ball and at least one guide rail extending in a rearward direction opposite the face, the guide rail having a convex surface characterized by a radius of rotation about an axis substantially parallel to a plane of the face. The adjustable golf club head further includes a club body including a sole portion having a concave surface configured to receive the convex surface of the at least one guide rail. A loft angle of the face unit is adjusted by translating the guide rail relative to the sole portion.

In yet another aspect in accordance with the disclosure, an adjustable golf club head includes a face unit including a face on a front side thereof and at least one guide rail extending in a rearward direction opposite the face and substantially perpendicular to the face, the guide rail having a downward facing convex surface, the convex surface being characterized by a radius of rotation about an axis parallel to the face. The adjustable golf club head further includes a club body including a heel portion, a toe portion opposite the heel portion, and a sole portion connecting the toe and heel portions. The sole portion includes an upper surface characterized by an upward facing concave surface configured to receive the downward facing convex surface of the at least one guide rail. The guide rail and the sole portion of the club body are configured to be coupled via one or more fasteners at a plurality of relative positions in a direction perpendicular to the face to adjust a loft angle of the face of the face unit.

As previously stated, the above-described embodiments and implementations are for illustration purposes only. Numerous other embodiments, implementations, and details of the invention are easily recognized by those of skill in the art from the following descriptions and claims.

BRIEF DESCRIPTION OF THE DRAWINGS

Various objects and advantages and a more complete understanding of the present disclosure and teachings herein are apparent and more readily appreciated by reference to the following Detailed Description and to the appended claims when taken in conjunction with the accompanying Drawings wherein:

DETAILED DESCRIPTION

Figure 1B:
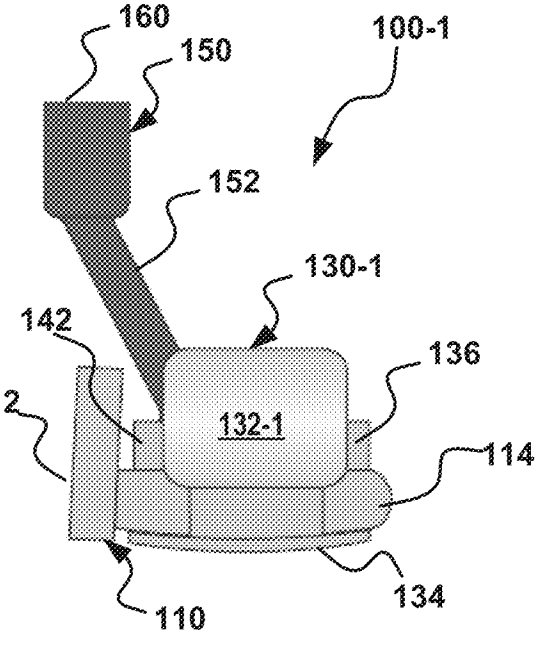
FIGS. 1A-1D are a top view, side view, front view and rear view, respectively, of an exemplary adaptable blade putter in accordance with the disclosure.
Figure 1A:
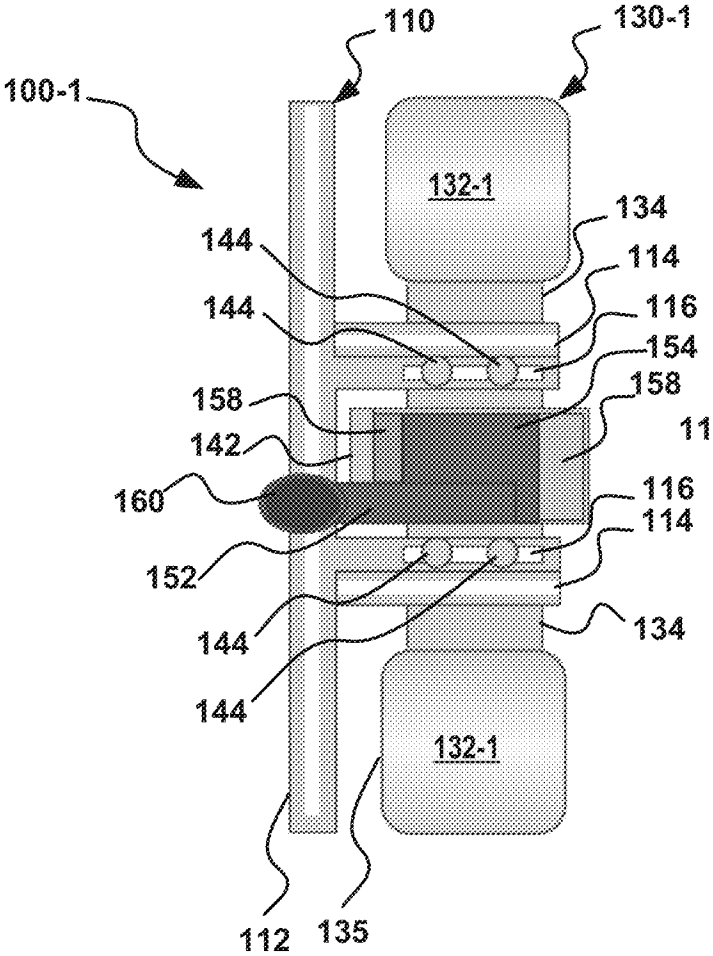
Figure 1C:
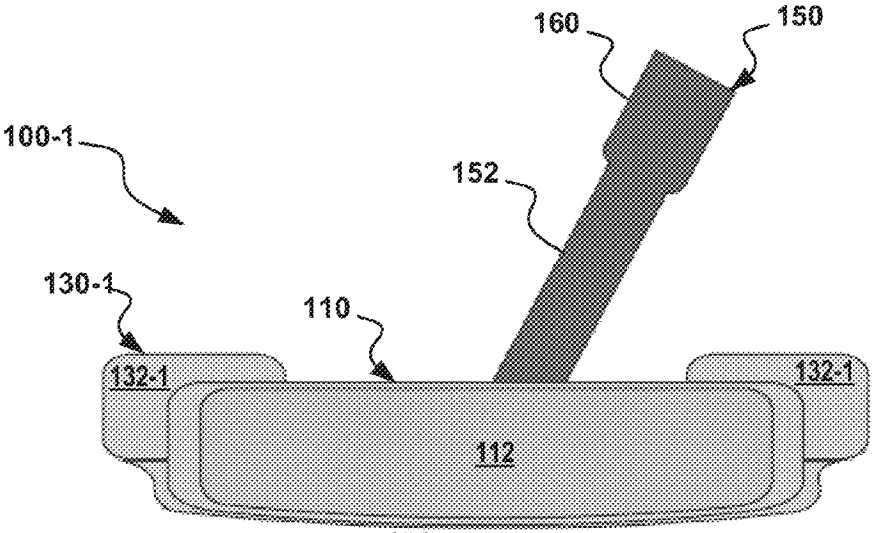
Figure 1D:
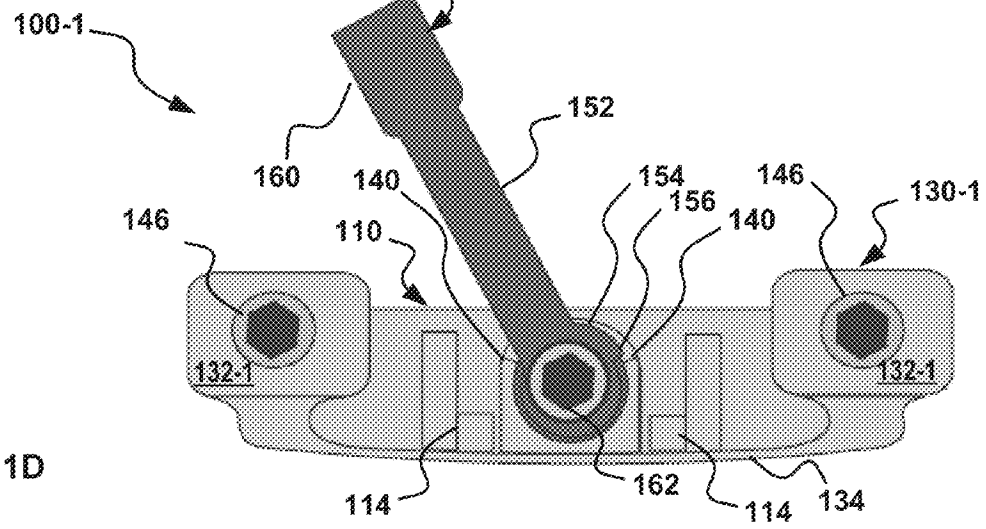
Figure 2B:
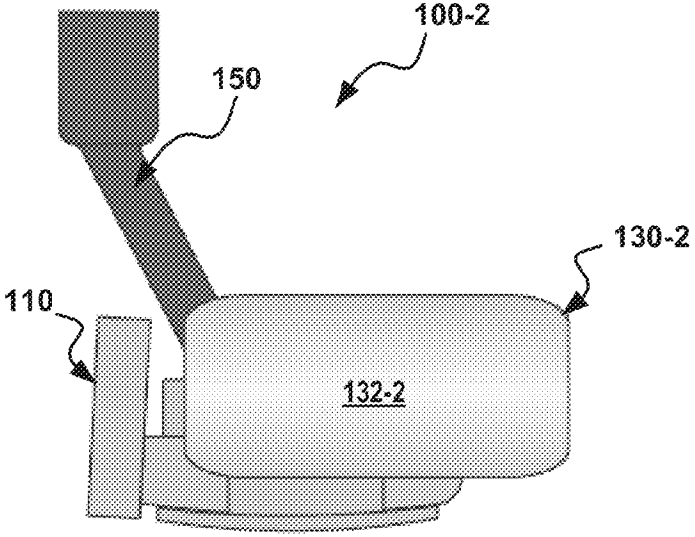
FIGS. 2A-2D are a top view, side view, front view and rear view, respectively, of an exemplary adaptable mallet putter in accordance with the disclosure.
Figure 2A:
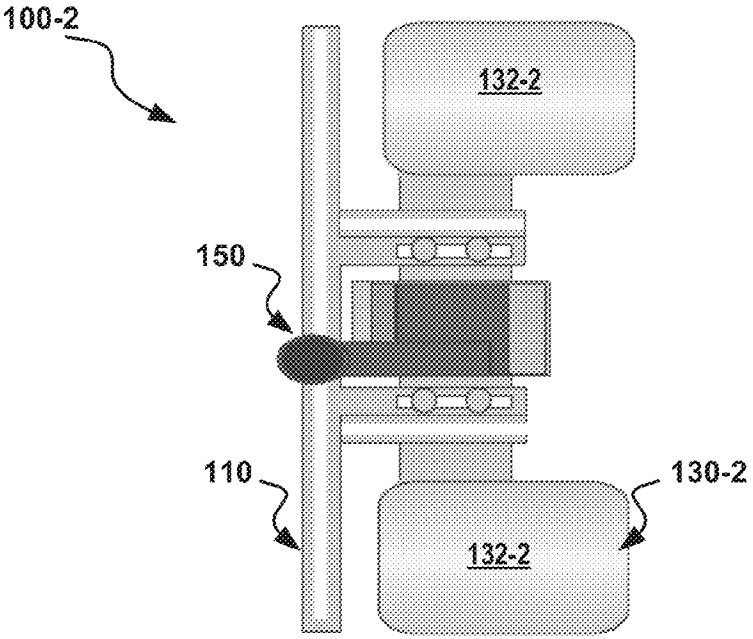
Figure 2C:
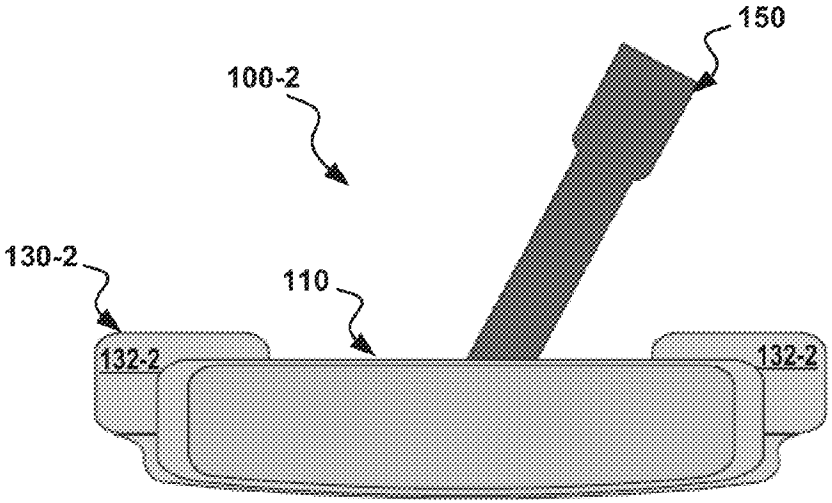
Figure 2D:
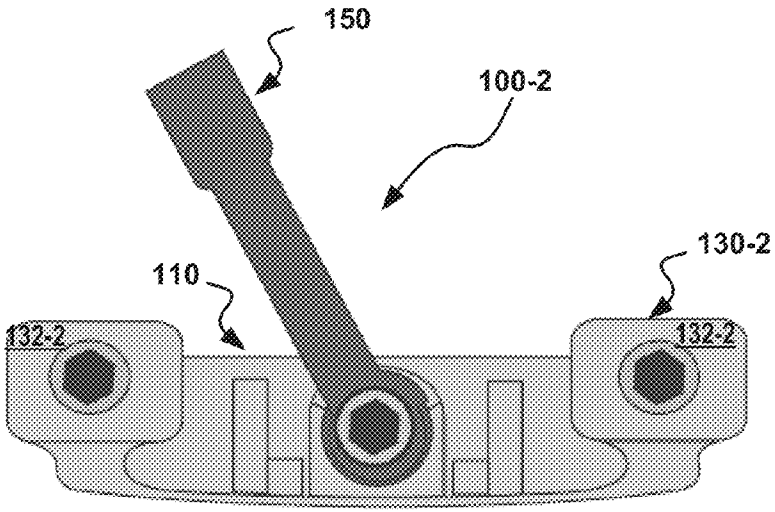

The present disclosure describes adjustable putter systems that provide for multiple ways to adjust the putter to fit different golfers. The adjustable putters can be configured to be adjusted to provide at least one of an adjustable lie angle of a hosel neck, an adjustable offset distance of a shaft relative to a face of the putter, and a loft angle of the face.

The adjustable putters described herein are the epitome of adjustability. Using a single tool each of the following specifications or parameters can be custom fit for any golfer: loft angle, lie, angle, shaft length, hosel offset, dexterity and weight. In some embodiments, at least three of these parameters can be adjusted on a golf club (e.g., putter). In some embodiments, the adjustable putter is made at least in part of in soft feeling aluminum. The adjustable putter can also incorporate vibration dampening polyurethane in hosel bushings and a face insert to contribute to smooth performance. Although embodiments herein describe the adjustability of a putter, it should be understood the adjustable features described herein can be applied or incorporated within other types of golf clubs.

FIGS. 1A-1D illustrate a top view, a left side view, a front view and a back view, respectively of a head assembly and hosel of an adjustable blade putter 100-1. The blade putter 100-1 includes a face unit 110 (also referred to as a "face"), a blade body 130-1 (also referred to as a "body") and a hosel 150. The blade putter 100-1 also includes a shaft (not shown) that can be coupled to a shaft adapter 160 of the hosel 150.

The face unit 110 defines a substantially planar face 112. The face unit 110 includes two alignment rails 114. The alignment rails 114 define screw slots 116 that allow screws or other body fasteners 144 to couple the face unit 110 to the blade body 130-1. The face unit 110 is attached to the blade body 130-1 via four screws and nuts that feed through the screw slots 116 and into four screw holes in a body sole 134.

Figure 6B:
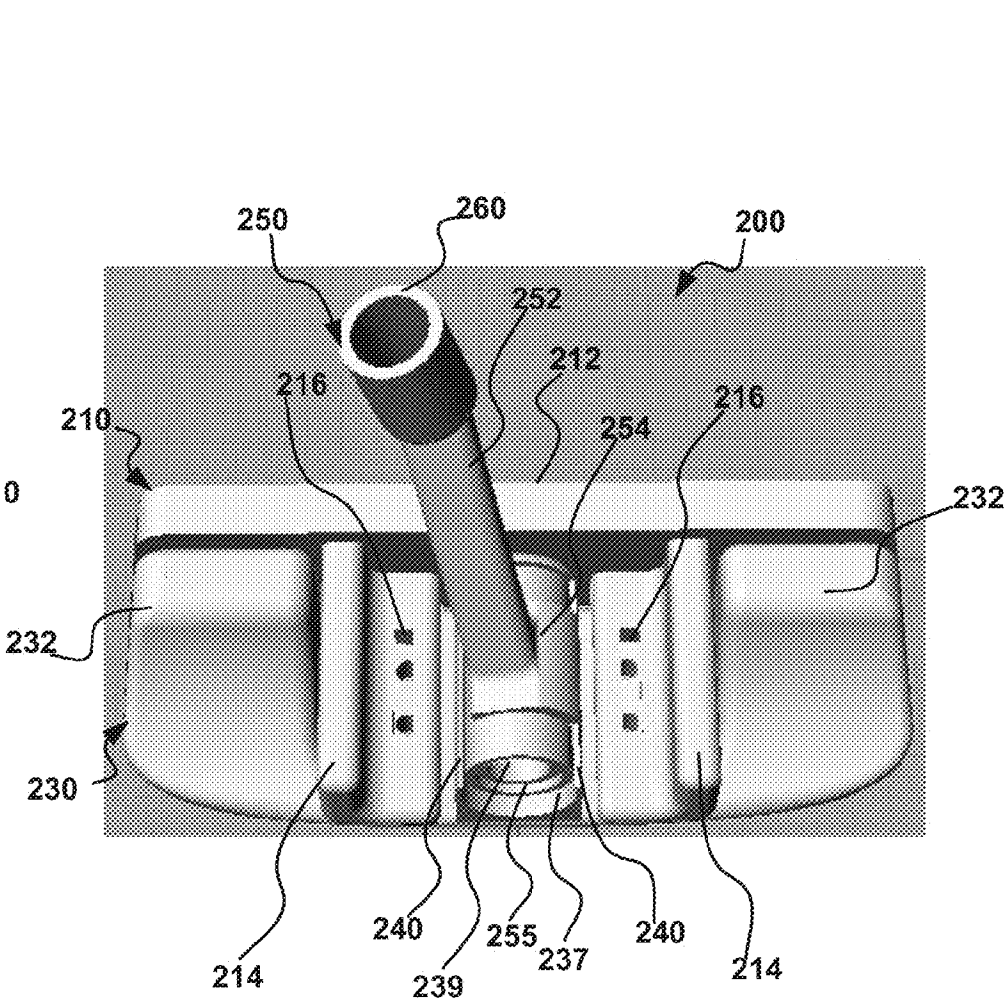
FIGS. 6A and 6B show a toe-side view and a top view, respectively, of the blade putter of FIGS. 5A and 5B.
Figure 6A:
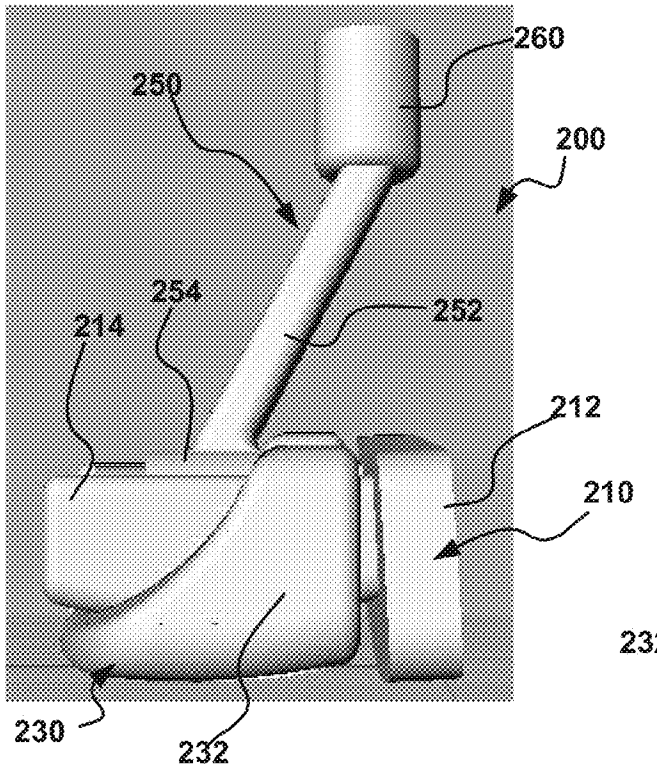
Figure 7B:
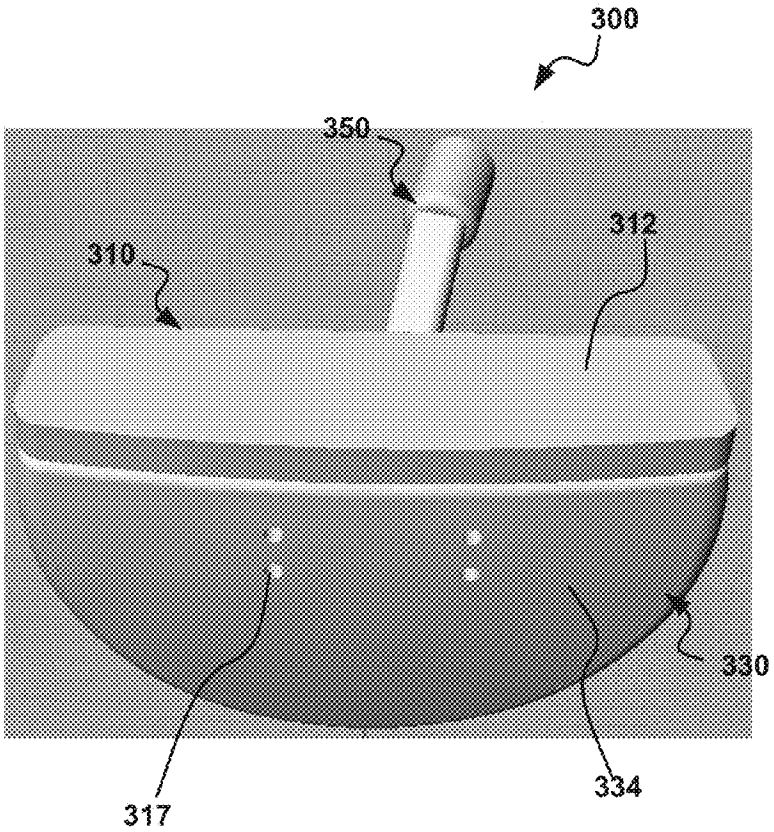
FIGS. 7A and 7B show a first perspective view and a second perspective view of a mallet putter in accordance with the disclosure.
Figure 7A:
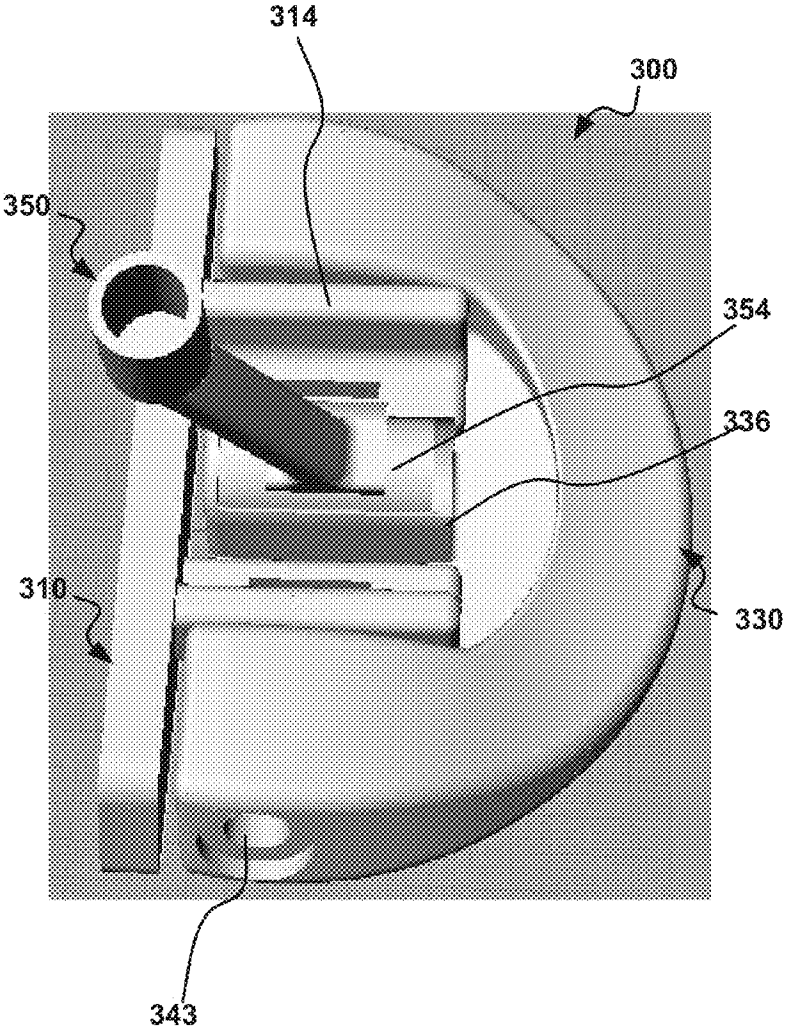
Figure 8B:
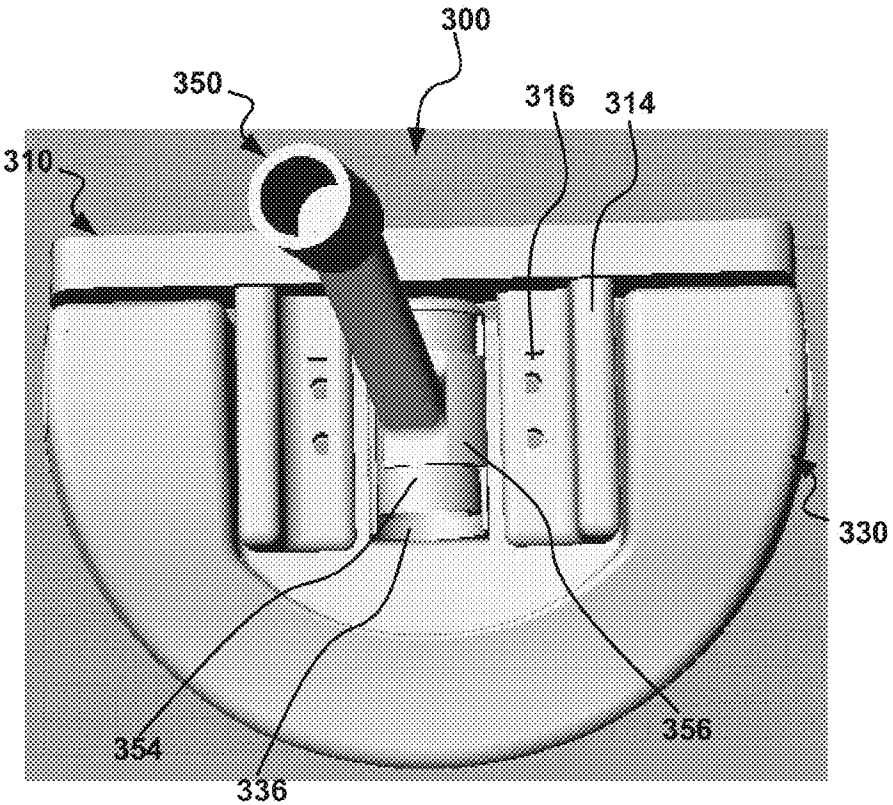
FIGS. 8A and 8B show a toe-side view and a top view, respectively, of the mallet putter of FIGS. 7A and 7B.
Figure 8A:
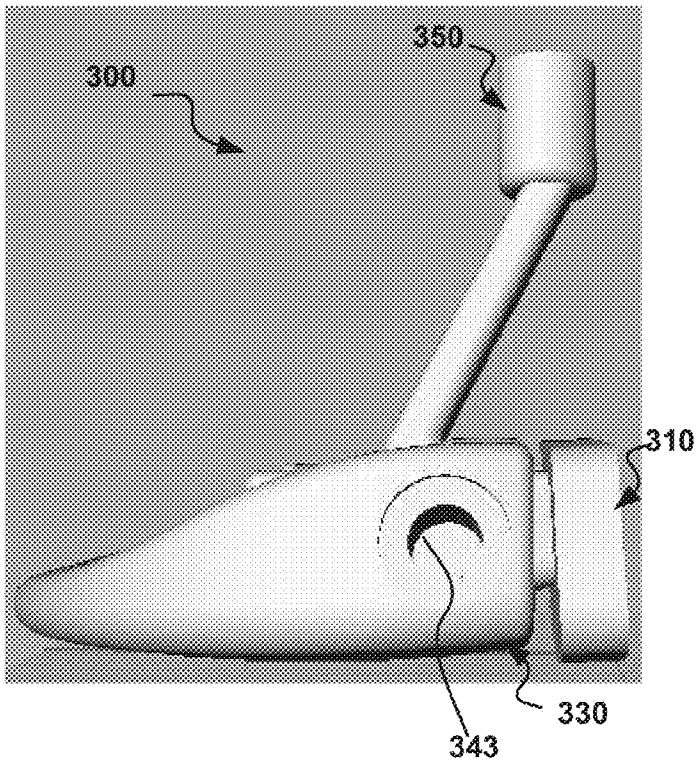
Figure 9B:
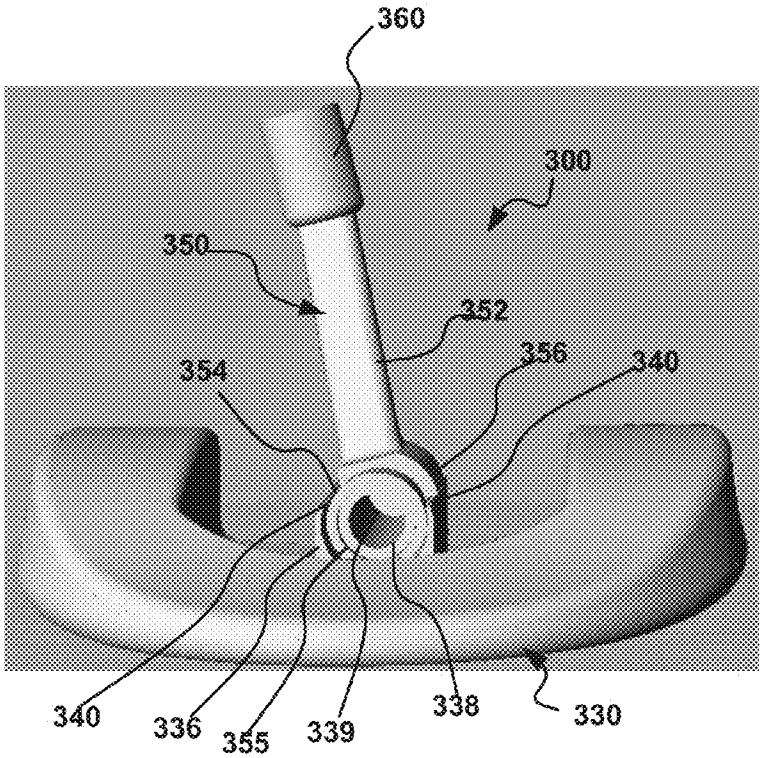
FIGS. 9A and 9B show front and rear perspective views, respectively, of the mallet putter body and hosel of the mallet putter of FIGS. 7A, 7B, 8A and 8B.
Figure 9A:
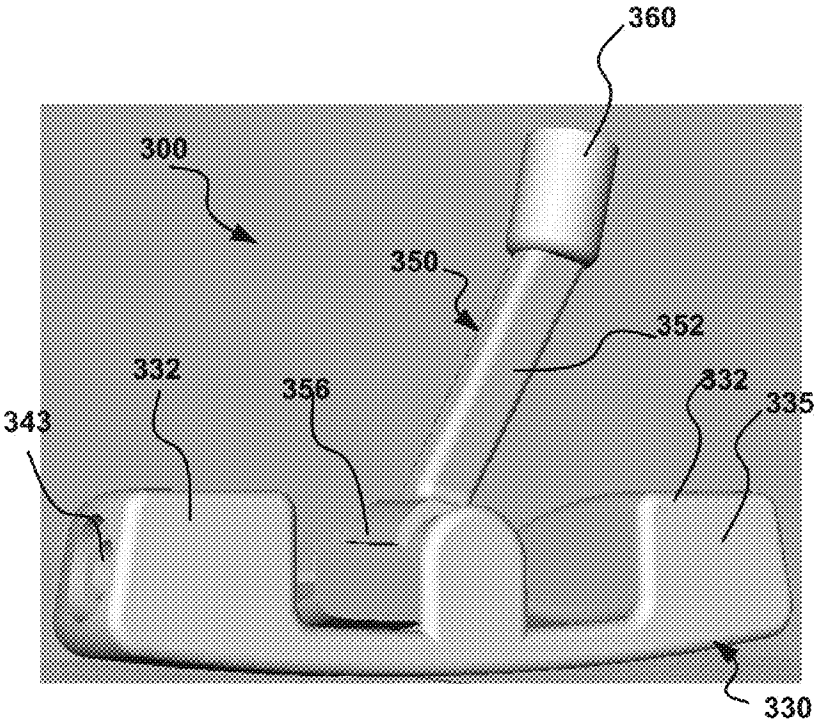
Figure 10A:
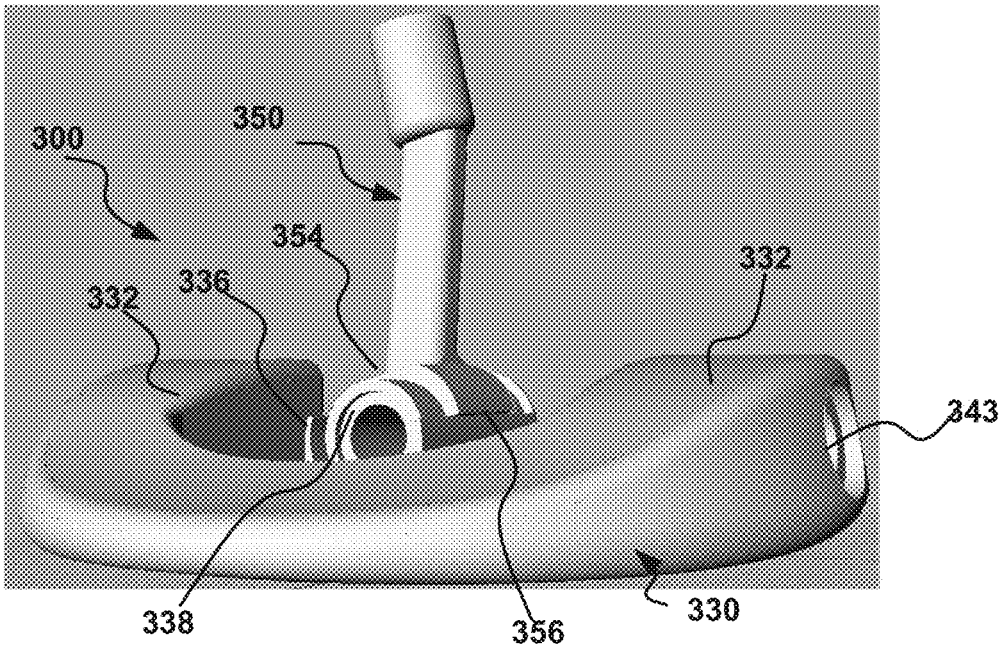
FIGS. 10A and 10B show alternative rear and front perspective views of the mallet putter body and hosel of FIGS. 9A and 9B.
Figure 10B:
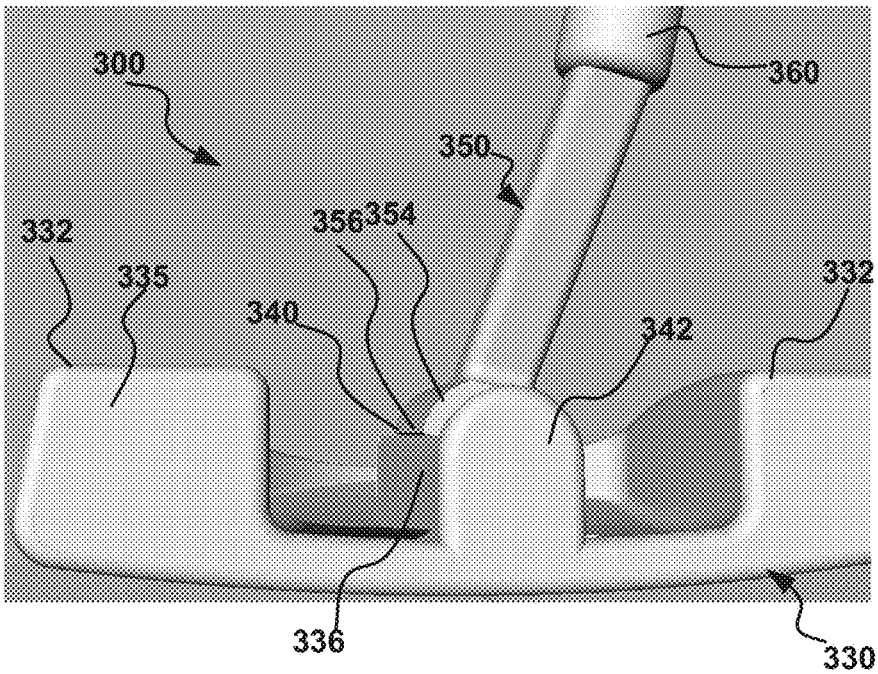
Figure 12A:
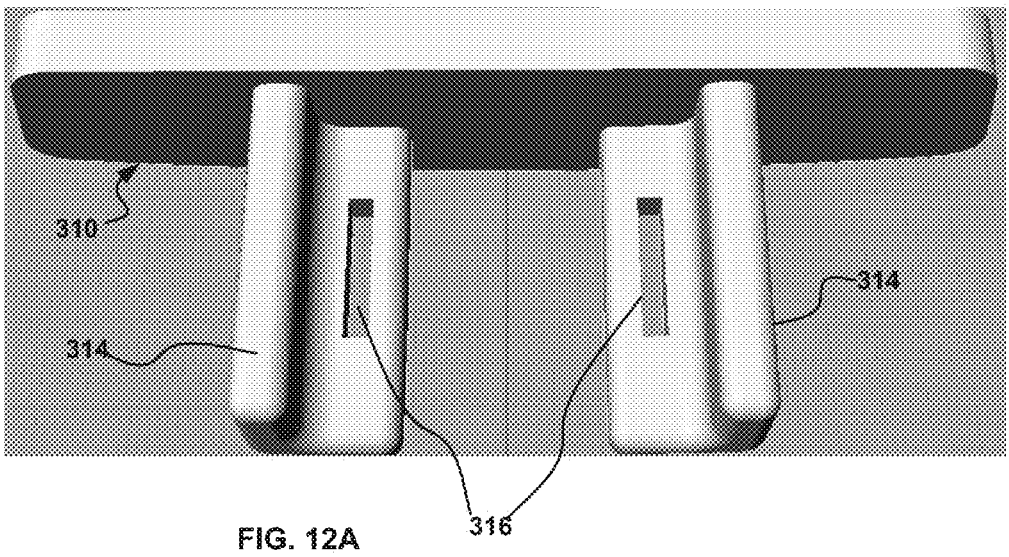
FIGS. 12A, 12B and 12C show first, second and third perspective views of a face unit of the mallet putter of FIGS. 7A, 7B, 8A and 8B.
Figure 12B:
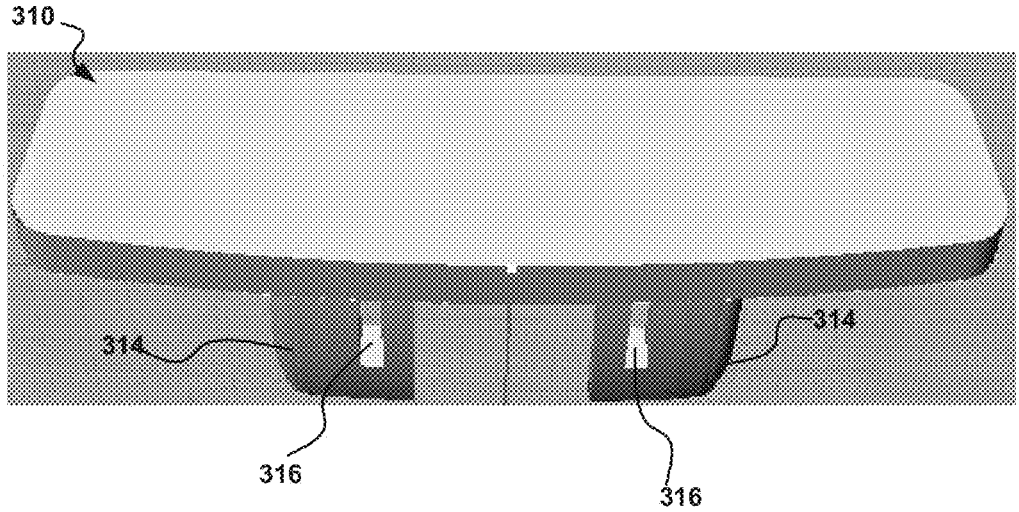
Figure 12C:
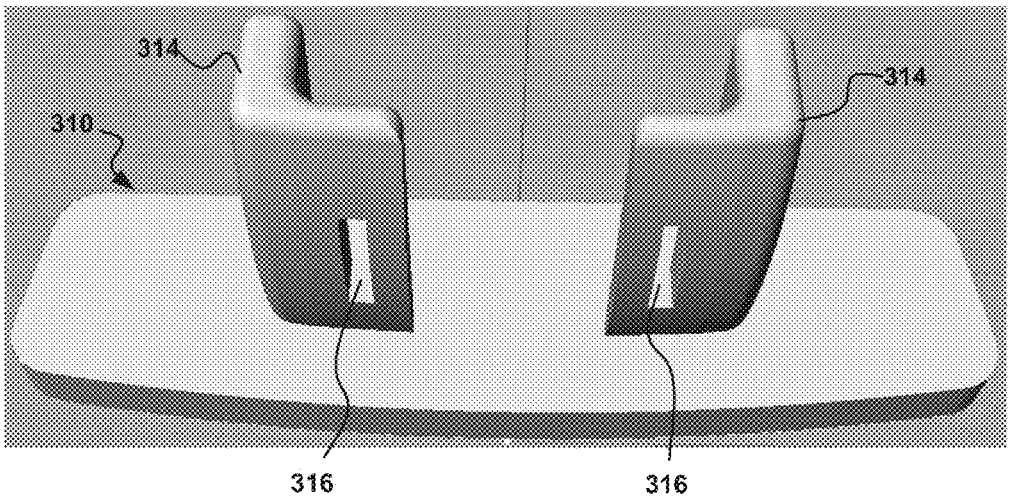
Figure 13:
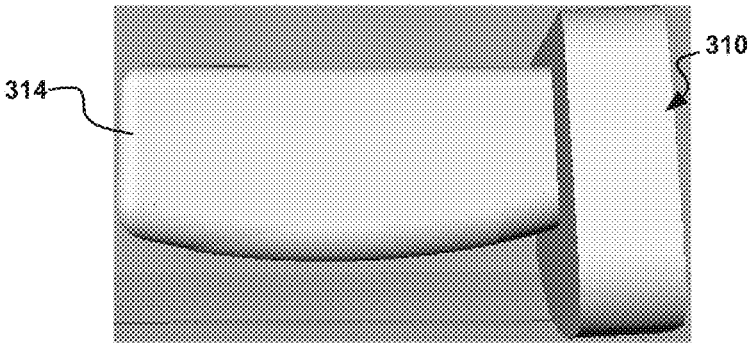
FIG. 13 shows a side view of the face unit of FIGS. 12A, 12B and 12C.

As shown best in the left side view of FIG. 1B (and in other embodiments such as, for example, the embodiment of FIGS. 6B, 8B and 12A), the alignment rails 114 are configured with a convex lower surface that is configured to fit into a concave upper surface of the body sole 134. The radius of rotation of the lower surface of the alignment rails 114 and the upper surface of the body sole 134 is sized to allow the alignment rails 114 to slide along the body sole 134 to provide varying loft angles as described in more detail below. For example, loft angles can be varied between about 1° and 5°. The radius of rotation in this embodiment is about 62 mm.

Figure 4A:
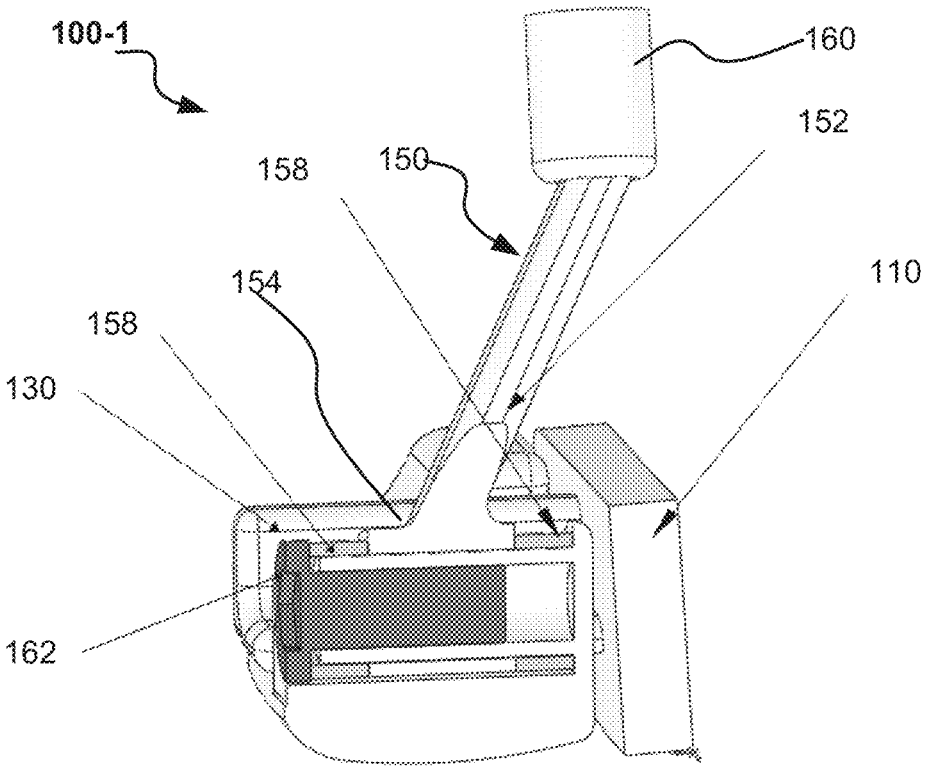
FIG. 4A shows a cutaway side view of a hosel and face unit of an adjustable putter in accordance with the disclosure.
Figure 4C:
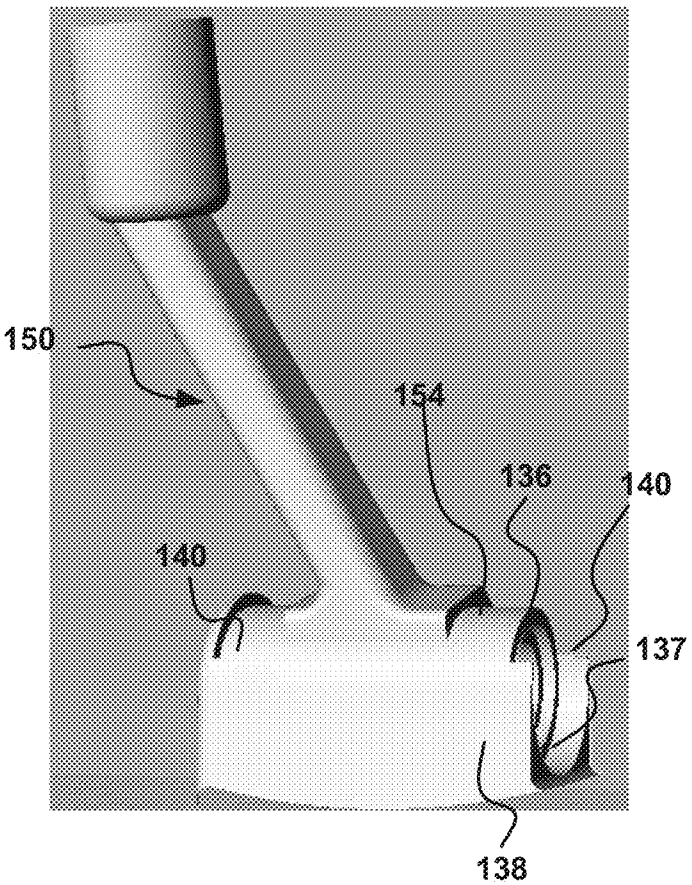
FIG. 4C shows a side view of the hosel of FIG. 4A.
Figure 4B:
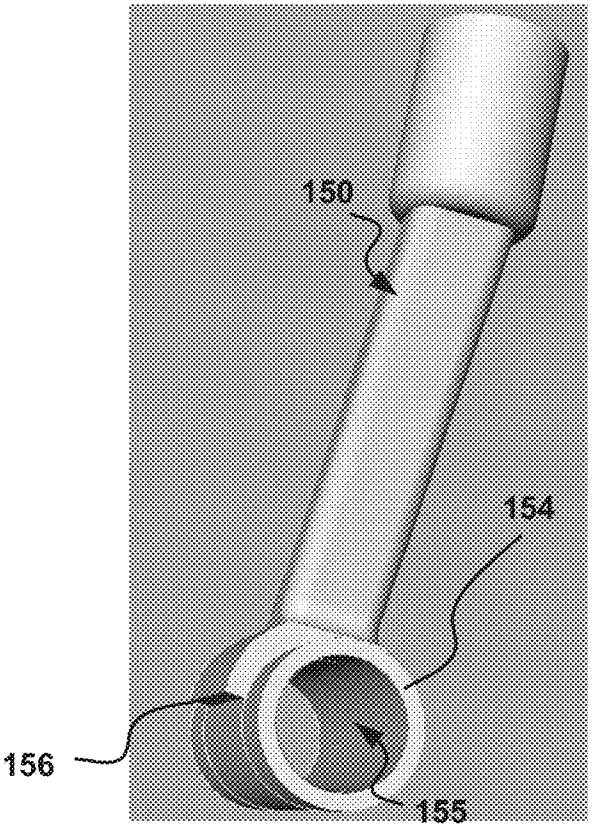
FIG. 4B shows a perspective view of the hosel of FIG. 4A.
Figure 5A:
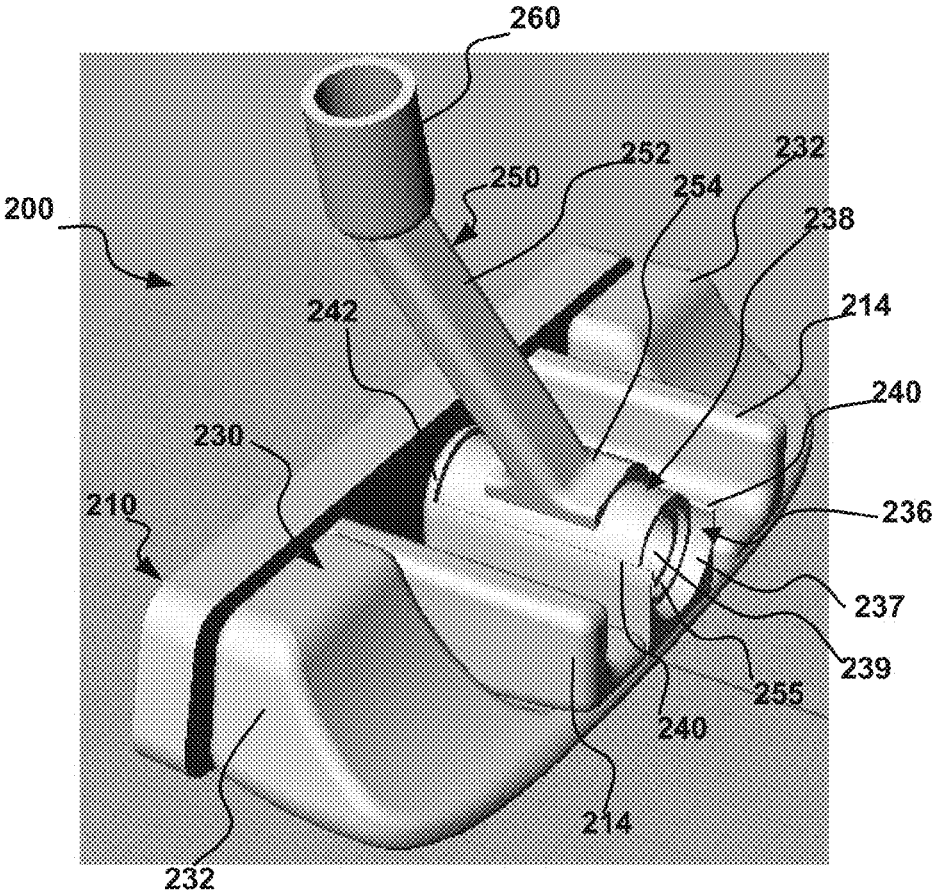
FIGS. 5A and 5B show a first perspective view and a second perspective view of a blade putter in accordance with the disclosure.
Figure 5B:
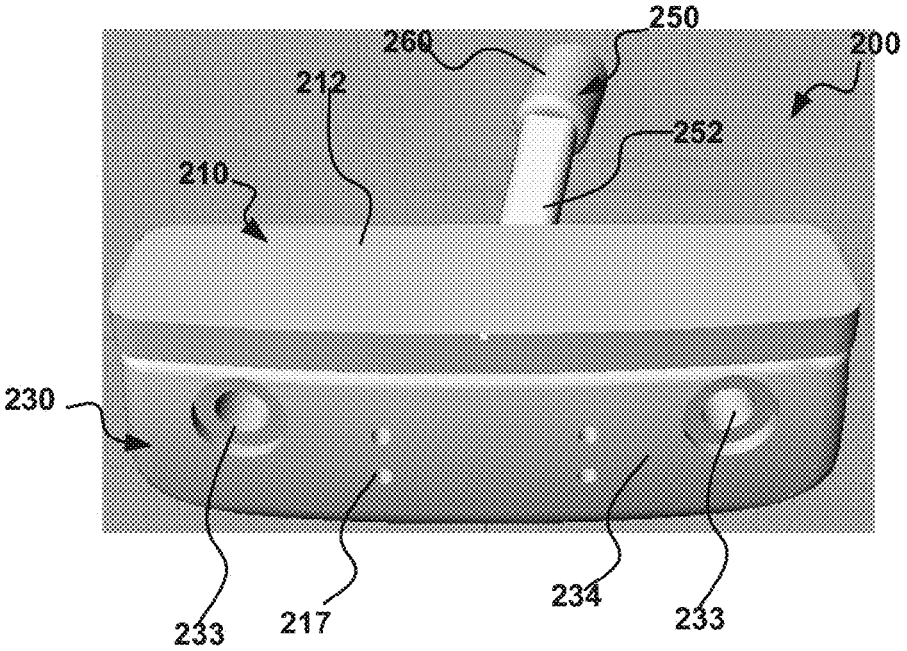
Figure 11A:
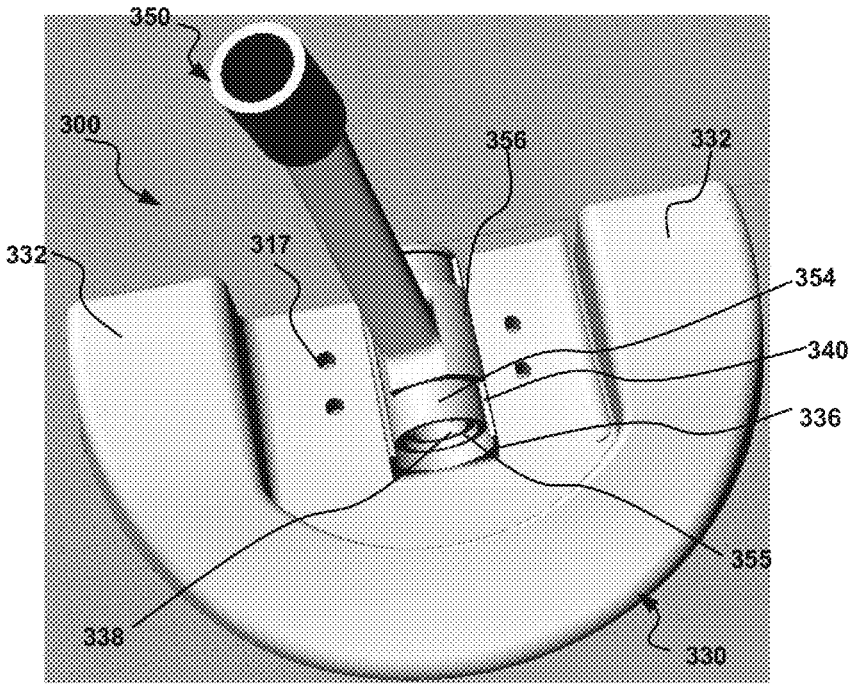
FIGS. 11A and 11B show a top perspective view and a rear view of the mallet putter body and hosel of FIGS. 9A, 9B, 10A and 10B.
Figure 11B:
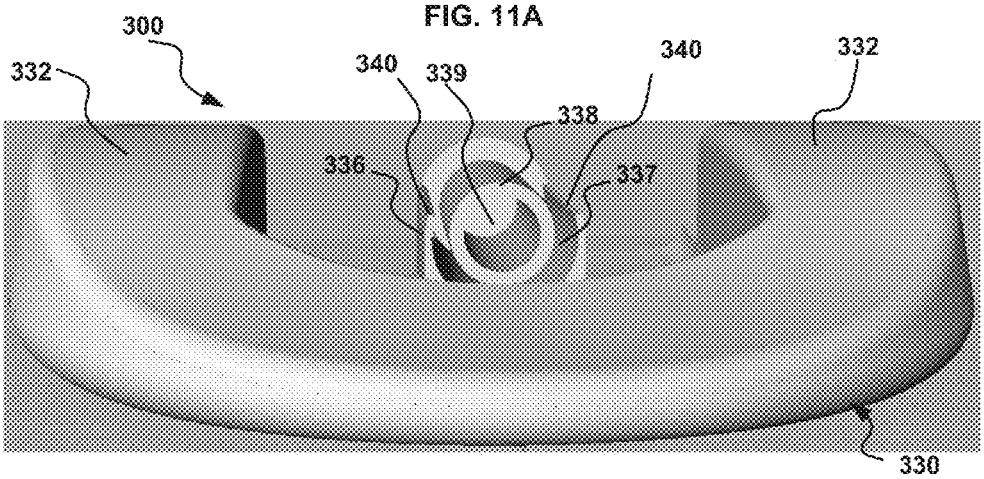

The blade body 130-1 includes toe and heel side portions 132-1, the body sole 134, a body face 135, and a hosel housing 136 that defines a hosel chamber 137 (see also, e g., the embodiments of FIGS. 4B, 5A, and 11B). The blade body 130-1 also includes a housing column 138 (see, also e.g., the embodiments of FIGS. 4B, 5A and 11B) defining a pair of hosel flanges 140 and including a housing face 142 to which the housing column 138 is coupled. The blade body 130-1 is attached to the face unit 110 via four body fasteners 144 (e.g., screws). The blade body 130-1 also includes weight ports configured to accept weighting screws 146. Further details and the function of the weight ports and weighting screws are described in more detail below.

The housing column 138 is contained in the hosel chamber 137 defined by the hosel housing 136. The housing column 138 can be threaded in an interior channel such that a hosel bolt 162 can be threaded into the cylindrical housing column 138 to attach the hosel 150 and bushings 158 (or more) to the blade body 130-1. The hosel bolt 162 threads into the housing column 138 and creates pressure against the bushings 158 and the hosel 150. As the hosel bolt 162 is tightened, it creates a force against the bushings 158 and the hosel 150. As described in more detail below, the weight, loft angle, lie angle and offset of the blade putter 100-1 can be adjusted to meet the needs of a particular golfer.

FIGS. 2A-2D illustrate a top view, a left side view, a front view and a back view, respectively, of a head assemble and hosel of an adjustable mallet putter 100-2. The mallet putter 100-2 can include the same face unit 110, hosel 150, bushings 158, fasteners 144 and the hosel bolt 162 as the putter 100-1 described above. The adjustable mallet putter 100-2 also includes a mallet body 130-2. The mallet body 130-2 can include larger heel and toe weight ports to accept larger weighting screws 146 than the blade putter 100-1. The weighting ports can be for example, in the body sole 134 and/or in the toe and heel side portions 132 of the mallet body 130-2. The toe and heal side portions 132-2 of the mallet body 130-2 can be formed as a single integral or monolithically formed component, rather than the two side units 132-1 of the blade body 130-1.

The mallet body 130-2 also has a deeper breadth dimension than the blade body 130-1 creating a larger footprint generally associated with mallet style putters. The mallet putter 100-2 can also have a higher moment of inertia (MOI) than the blade putter 100-1. As with the blade putter 100-1, the weight, loft angle, lie angle and offset adjustability are also available in the mallet putter 100-2.

Figures 3A, 3B, 3C:
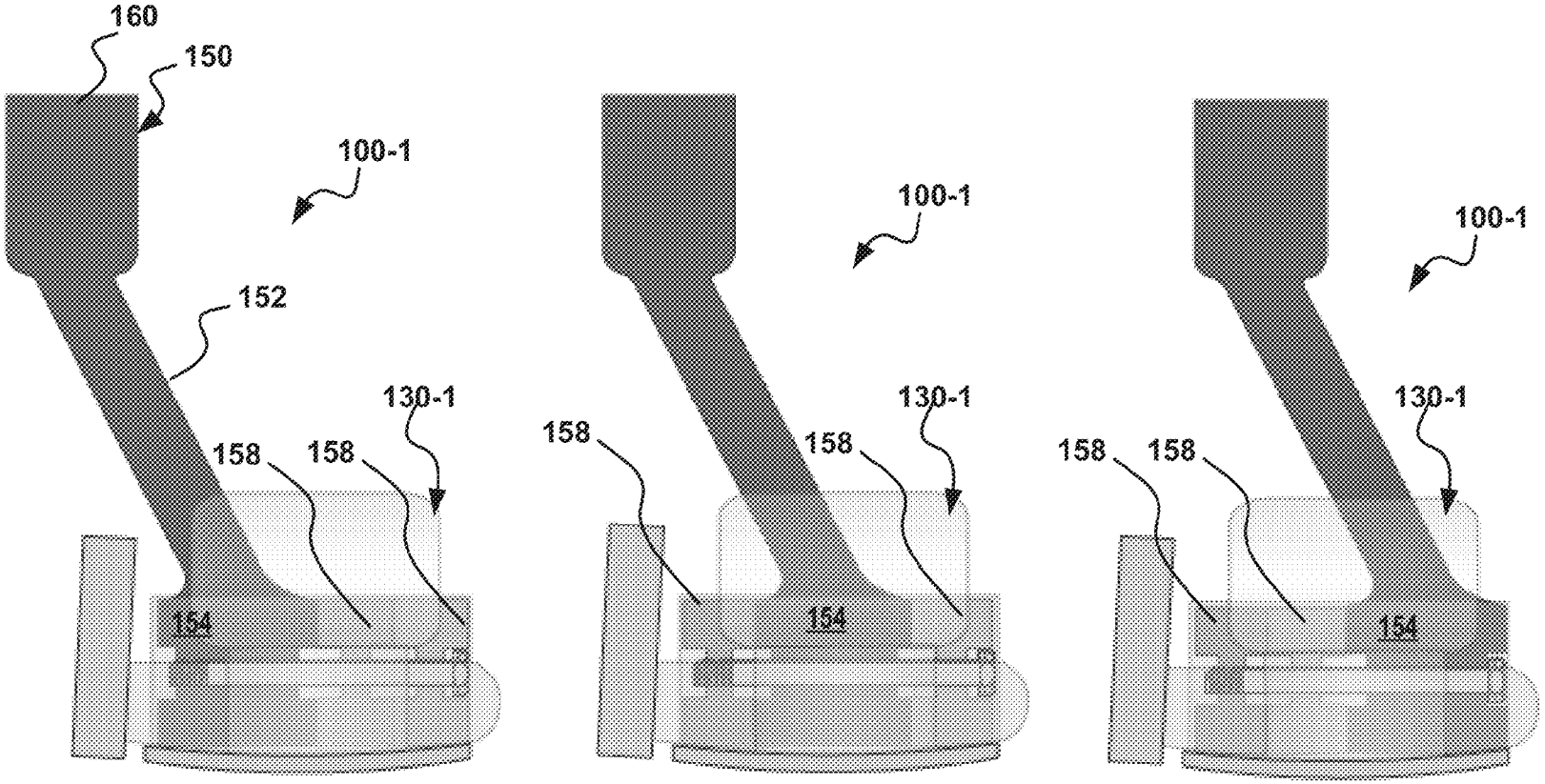
FIGS. 3A, 3B and 3C show side views illustrating an adjustable hosel offset feature of an adjustable putter in accordance with the disclosure.

FIGS. 3A-3C illustrate the adjustability of the offset of the putters 100-1 and 100-2. The relative locations of the bushings 158 and the hosel 150 on the housing column 138 provide for an adjustable hosel offset as illustrated in FIGS. 3A-3C (the blade body 130-1 is shown transparent in FIGS. 3A-3C for illustration purposes). The offset is measured as an offset distance between the hosel adapter 160 (or the shaft) relative to the face surface 112 of the putter. FIG. 3A shows a minimum offset configuration with the hosel 150 positioned closest to the face unit 110 and the two bushings 158 behind the hosel 150. FIG. 3B shows a medium offset configuration with one bushing 158 in front of the hosel 150 and one bushing 158 behind the hosel 150. This offset can also be referred to as "zero" offset. FIG. 3C shows a maximum offset configuration with both bushings 158 in front of the hosel 150. This offset can also be referred to as a "face progression" offset. In some embodiments, a single hosel (e.g., hosel 150) can provide various offset options utilizing, for example, two bushings (e.g., bushings 158). As described above, shifting the orientation of the bushings can provide the three different hosel settings for offset. A single bolt can anchor the hosel and bushings in place. Although shown and described with respect to the blade putter 100-1, the same configurations for the hosel 150 and bushings 158 can be used in the mallet putter 100-2 to adjust the offset.

The hosel 150 and its connection to the body 130-1 is described with reference to FIGS. 4A-4C. Although the hosel 150 and its coupling to the body 130-1 is described relative to the blade putter 100-1, it should be understood that a hosel 150 can be similarly coupled to the body 130-2 of the mallet putter 100-2. The hosel 150 includes a hosel neck 152, a hosel adapter 154 and a shaft adapter 160. The hosel adapter 154 defines an interior channel 155 (best shown in FIG. 4B) that is configured to accept the housing column 138 of the club body 130 (e.g., body 130-1 or 130-2). The pair of bushings 158 are each configured with an interior channel so as to accept the housing column 138. The hosel 150 and the bushings 158 are coupled to the club body 130-1, 130-2 via a hosel bolt 162. The shaft adapter 160 is configured to receive a shaft (not shown) of any length. As shown in FIGS. 4A-4C, the hosel adapter 154 includes a hosel edge 156 (best shown in FIG. 4B) that works in conjunction with a pair of hosel flanges 140 on the body unit 130-1, 130-2 (see also hosel flanges 140 in FIGS. 5A, 6B, 11B) to prevent the hosel neck 152 from having a lie angle less than 58° or greater than 79° (lie angle discussed in more detail below). In other words, the hosel edges 156 contact or engage the hosel flanges 140 to limit the rotational movement of the hosel 150. The hosel 150 shown in the FIGs. (e.g., 1A-1D, 2A-2D, 4A-4C) is a right handed hosel. However, a left handed hosel that is the mirror image of the right handed hosel 150 is shown in U.S. Provisional Application No. 61/799,513 ("the '513 application") incorporated herein by reference above.

FIGS. 5A, 5B, 6A and 6B illustrate various views of a head assembly and hosel of an adjustable blade putter 200, according to an embodiment. The blade putter 200 can be configured the same as or similar to, for example, the blade putter 100-1 described above. The blade putter 200 includes a face unit 210 (also referred to as a "face"), a blade body 230 (also referred to as a "body") and a hosel 250. The blade putter 200 also includes a shaft (not shown) that can be coupled to a shaft adapter 260 of the hosel 250.

The face unit 210 defines a substantially planar face 212 and includes two alignment rails 214. The alignment rails 214 define screw slots 216 (see, e.g., FIG. 6B) that allow screws or other body fasteners (not shown) to couple the face unit 210 to the blade body 230. For example, the face unit 210 can be attached to the blade body 230 via four screws and nuts that feed through the screw slots 216 and into four screw holes 217 in a body sole 234 (see, e.g., FIG. 5B). The slots 216 allow the face 210 to be adjustably coupled to the body 230 as described above for previous embodiments.

The blade body 230 includes toe and heel side portions 232, the body sole 234 and a hosel housing 236 that defines a hosel chamber 237 (see e.g., FIGS. 5A and 6B). The blade body 230 also includes a housing column 238 defining a pair of hosel flanges 240 and a housing face 242 to which the hosel housing 236 is coupled or formed therewith. The blade body 230 is coupled to the face unit 210 via the four body fasteners discussed above. The blade body 230 also includes weight ports 233 configured to accept weighting screws (not shown) as described above for previous embodiments and as described in more detail below.

The housing column 238 can include a threaded interior channel 239 such that a hosel bolt (not shown) can be threaded into the housing column 238 to couple the hosel 250 to the blade body 230. In some embodiments, two or more bushings (not shown) can also be included and coupled to the housing column 238 as described above for previous embodiments. The hosel bolt can thread into the housing column 238 and create pressure against the hosel 250 (and the bushings if included). As the hosel bolt is tightened, it creates a force against the hosel 250 (and bushings). As with previous embodiments, the positions of the hosel 250 (and bushings) on the housing column 238 can provide for adjustability of the hosel offset in the same or similar manner as described above relative to FIGS. 3A-3C.

The hosel 250 includes a hosel neck 252, a hosel adapter 254 and a shaft adapter 260. The hosel adapter 254 defines an interior channel 255 (see e.g., FIGS. 5A and 6B) that can receive therein the housing column 238 of the body 230. The bushings (when included) can each be configured with an interior channel that can also receive the housing column 238 therethrough. As described above, the hosel 250 (and bushings) can be coupled to the body 230 via a hosel bolt (not shown). The hosel adapter 254 includes a hosel edge 256 and when the hosel 250 is placed on the housing column 238, the hosel edge 256 can engage or contact one of the hosel flanges 240 on the hosel housing 236 to prevent or limit rotation of the hosel 250 relative to the housing column 238. As described above, this can prevent the putter 200 from having a lie angle less than 58° or greater than 79°, which would be outside of a range accepted by the USGA. The shaft adapter 260 is configured to receive a shaft (not shown) and couple the shaft to the hosel 250.

FIGS. 7A, 7B and 8A, 8B illustrate various views of a head assembly and hosel of an adjustable mallet putter 300, according to an embodiment, and FIGS. 9A-13 illustrate various views and portions of the adjustable mallet putter of FIGS. 7A, 7B and 8A, 8B. The mallet putter 300 can be configured the same as or similar to, for example, the mallet putter 100-2 described above. The mallet putter 300 includes a face unit 310 (also referred to as a "face"), a blade body 330 (also referred to as a "body") and a hosel 350. The blade putter 300 also includes a shaft (not shown) that can be coupled to a shaft adapter 360 of the hosel 350.

The face unit 310 defines a substantially planar face 312 and includes two alignment rails 314. The alignment rails 314 define screw slots 316 (see FIGS. 8B and 12A-12C) that can receive therethrough screws or other body fasteners (not shown) to couple the face unit 310 to the blade body 330. For example, the face unit 310 can be attached to the blade body 330 via four screws and nuts that feed through the screw slots 316 and into four screw holes 317 in a body sole 334 (see, e.g., FIG. 7B). The slots 316 allow the face 310 to be adjustably coupled to the body 330 as described above for previous embodiments.

The blade body 330 includes toe and heel side portions 332, the body sole 334 and a hosel housing 336 that defines a hosel chamber 337 (see e.g., FIGS. 8B, 9B, 11A and 11B). The blade body 330 also includes a housing column 338 defining a pair of hosel flanges 340 and a housing face 342 (see, e.g., FIG. 10B) to which the hosel housing 236 is coupled or formed therewith. The blade body 330 is coupled to the face unit 310 via the four body fasteners discussed above. The blade body 330 also includes weight ports 343 (see e.g., FIGS. 7A, 8A and 10A) in an end portion of the side portions 332 configured to accept weighting screws (not shown) as described above for previous embodiments and as described in more detail below.

The housing column 338 can include a threaded interior channel 339 such that a hosel bolt (not shown) can be threaded into the housing column 338 to couple the hosel 350 to the blade body 330. In some embodiments, two or more bushings (not shown) can also be included and coupled to the housing column 338 as described above for previous embodiments. The hosel bolt can thread into the housing column 338 and create pressure against the hosel 350 (and the bushings if included). As the hosel bolt is tightened, it creates a force against the hosel 350 (and bushings). As with previous embodiments, the positions of the hosel 350 (and bushings) on the housing column 338 can provide for adjustability of the hosel offset in the same or similar manner as described above relative to FIGS. 3A-3C.

The hosel 350 includes a hosel neck 352, a hosel adapter 354 and a shaft adapter 360. The hosel adapter 354 defines an interior channel 355 (see e.g., FIGS. 10A and 11A) that can receive therein the housing column 338 of the body 330. When included, the bushings (not shown) can each be configured with an interior channel that can also receive therethrough the housing column 338. As described above, the hosel 350 (and the bushings when included) can be coupled to the body 330 via a hosel bolt (not shown). The hosel adapter 354 includes a hosel edge 356 and when the hosel 350 is placed on the housing column 338 the hosel edge 356 can engage or contact one of the hosel flanges 340 on the hosel housing 336 to prevent or limit rotation of the hosel 350 relative to the housing column 338. As described above, this can prevent the putter 200 from having a lie angle less than 58° or greater than 79°, which would be outside of a range accepted by the USGA. The shaft adapter 360 is configured to receive a shaft (not shown) and couple the shaft to the hosel 350.

Each of the adjustable putters 100-1, 100-2, 200, and 300 described above can be adapted or configured to adjust one or more parameters of the putter, such as, for example, weight, lie angle, loft angle and/or shaft or hosel offset of the putter, as described herein. Although adjustability of the blade putter 100-1 is described below with reference to FIGS. 14-21 (and above with reference to FIGS. 3A-3*c* for offset), it should be understood that the same features and functions can apply to any of the embodiments of an adjustable putter described herein.

Figure 14:
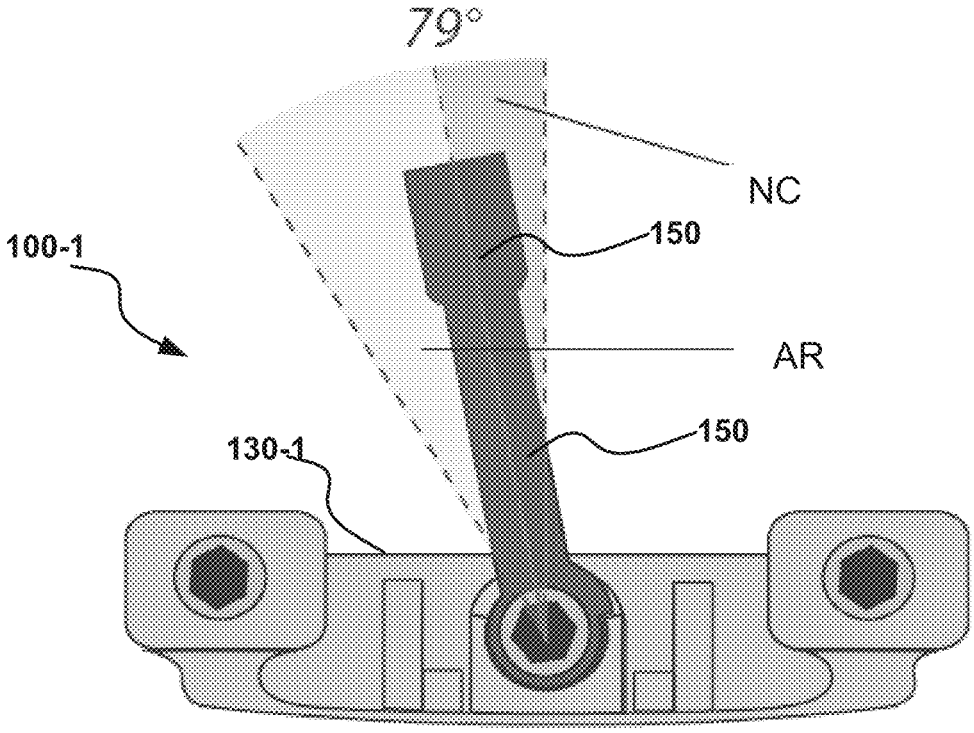
FIGS. 14-16 are each a rear view of the putter of FIGS. 1A-1D, each of which shows the putter with a different lie angle.
Figure 15:
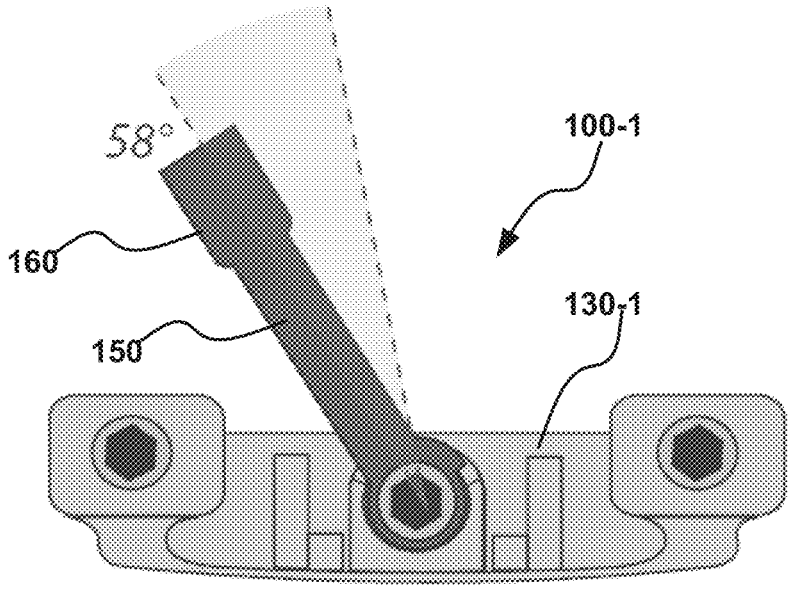
Figure 16:
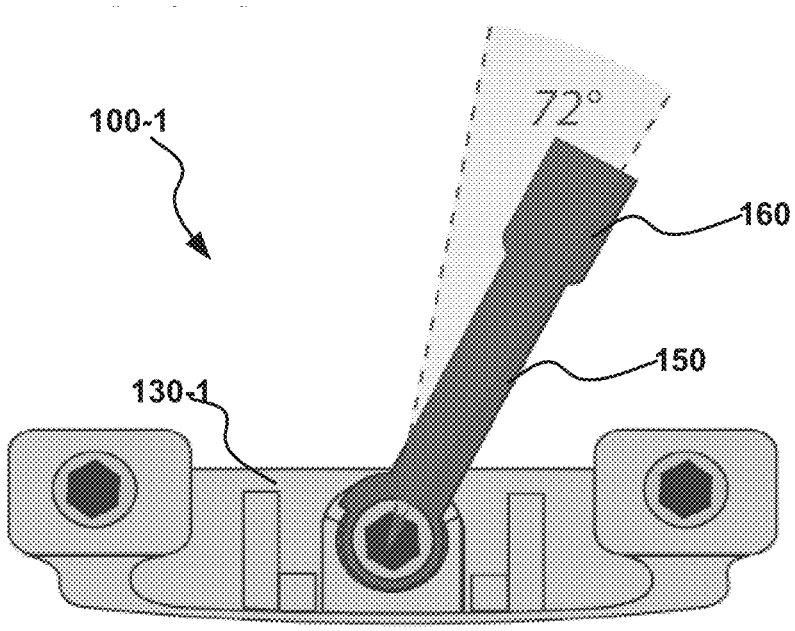
Figure 17:
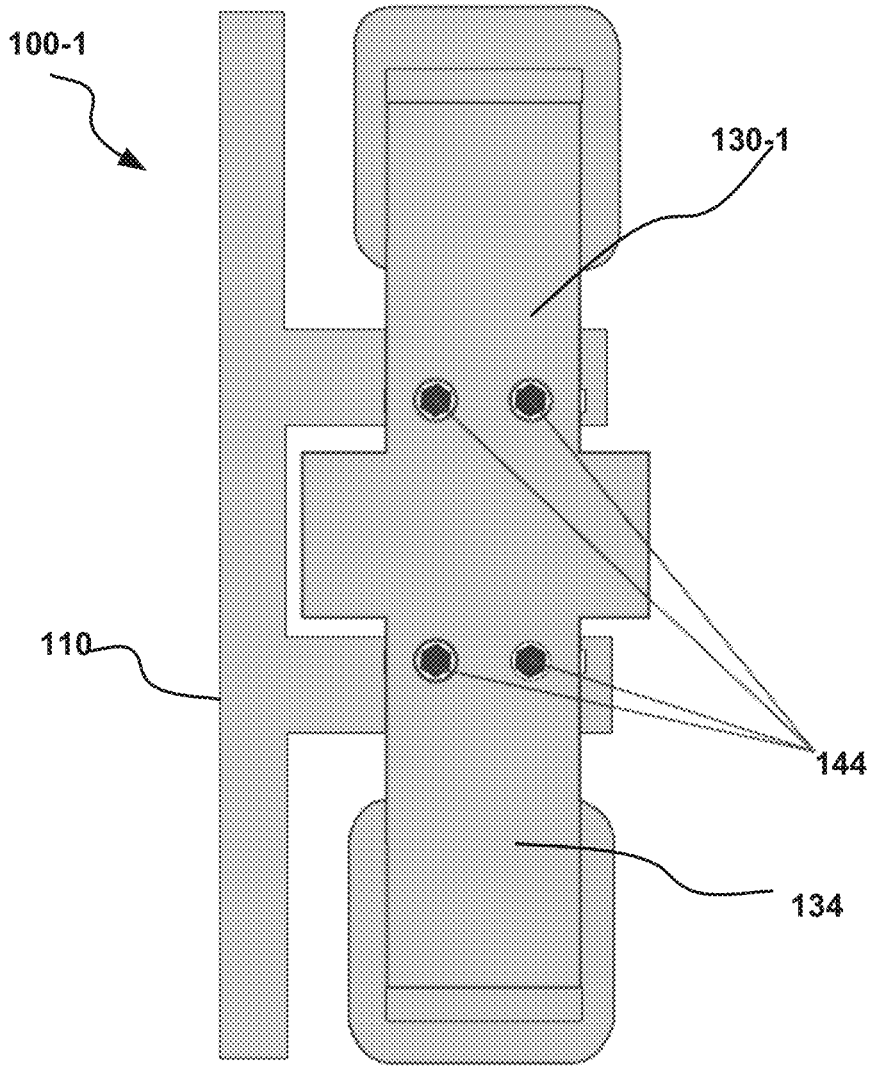
FIG. 17 is a bottom view of the putter of FIGS. 1A-1D.

FIGS. 14-16 illustrate the adjustability of the lie angle of the adjustable blade putter 100-1. The lie angle is an angle measured from a bottom surface of the body 130-1 (or sole 134 of the putter) to a centerline of the hosel 150 and shaft adapter 160 (see also the '513 application incorporated by reference). As shown in FIG. 14, a non-conforming lie angle range for USGA is shown in the area labeled NC, and the acceptable lie angle range is shown in the area labeled AR. The area AR illustrates the lie angle ranges between 58° and 79°, with the centerline of the shaft adapter 160 disposed at 79°. FIG. 14 illustrates the putter 100-1 having a lie angle of 79° and FIG. 15 shows the lie angle at the low end of the range AR (i.e., 58°). FIG. 16 illustrates the hosel 150 assembled for a left handed user at a lie angle of 72°. Thus, the main body of the putter 100-1 is universal to dexterity and can be assembled for use by a right handed or left handed user.

Figure 18:
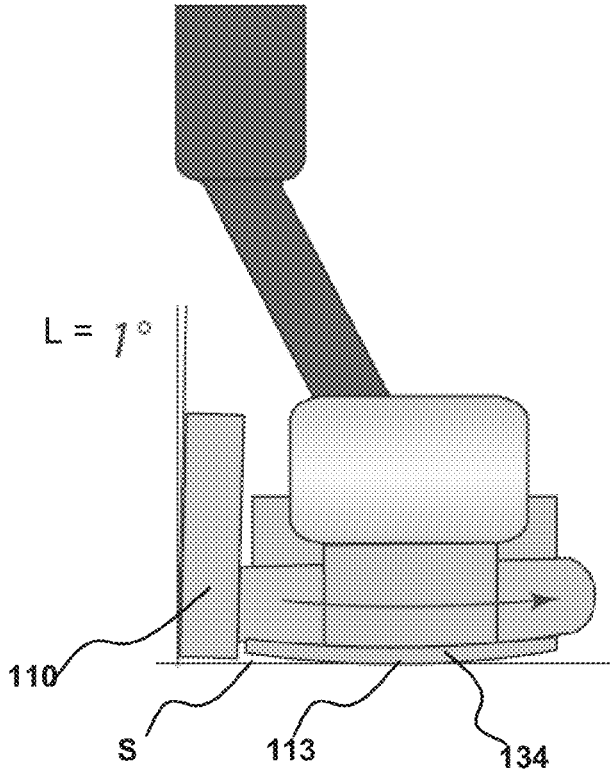
FIGS. 18 and 19 are each a side view of the putter of FIG. 1 showing the putter with different loft angles.
Figure 19:
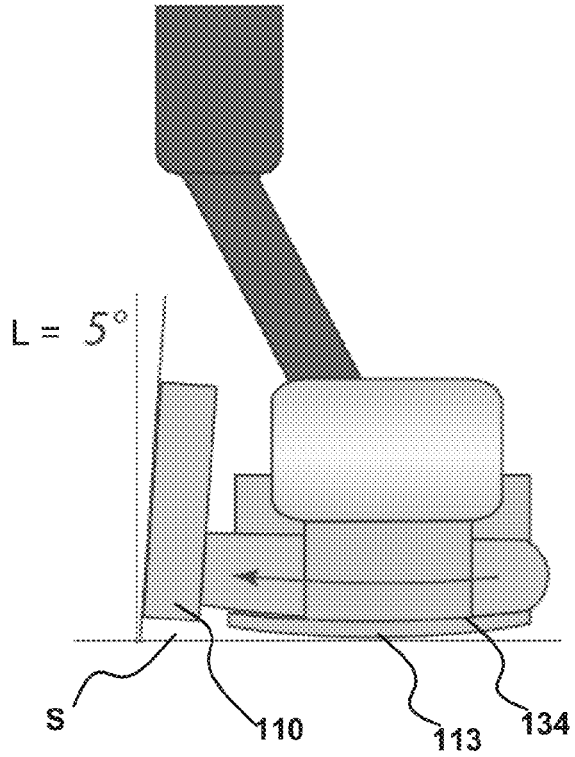

The putter 100-1 (and putter 100-2) can also be adjusted for loft angle. The loft angle L (see FIGS. 18 and 19) is the angle of a front surface of the face 110 relative to a bottom surface 113 of the sole portion 134 of the putter 100-1 (100-2) or surface S on which the putter is disposed. To adjust the loft angle L, the body fasteners 144 (see, e.g., FIG. 17) can be loosened to allow face unit 110 to slide forward and rearward, which changes the loft angle L. Since the hosel housing 136 is part of the body casting there is no affect on the hosel or shaft position when the loft is altered on the face 110. Lofts can range, for example, from 1° to 5°. FIG. 18 illustrates the putter 100-1 with a loft angle of 1°, and FIG. 19 illustrates the putter 100-1 with a loft angle of 5°.

Figure 20:
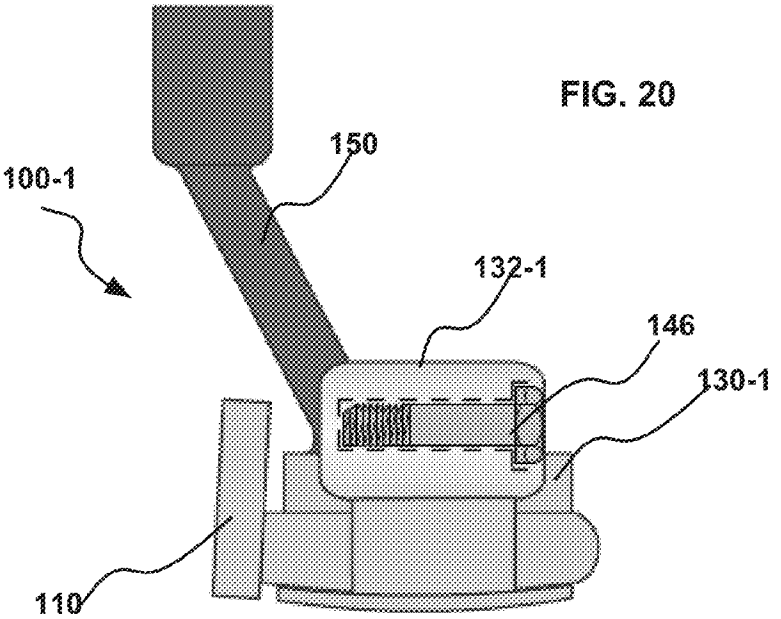
FIG. 20 is a side view and FIG. 21 is a rear view of the putter of FIGS. 1A-1D illustrating weight adjustability of the putter.
Figure 21:
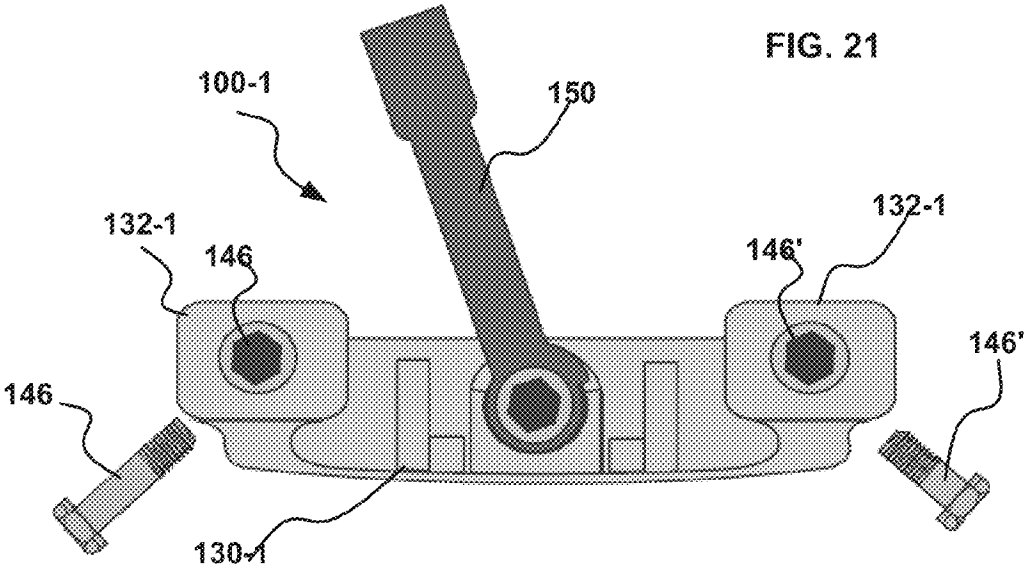

The weight of the putters 100-1 and 100-2 can also be adjusted. As described above, the putters 100-1, 100-2 include heel and toe weight ports that can be used to increase the MOI of the putter. For example, as shown in FIGS. 20 and 21, the putter 100-1 includes weight ports defined in the side portions 132-1 that can receive a weighting screw or bolt 146. The weighting screw or bolt can be a variety of different weights such that a user can adjust the weight of the putter by changing the weighting bolt 146. FIG. 21 illustrates an example of a weighting bolt 146 than can weigh, for example, 10 grams, and a weighting bolt 146 that can weigh, for example, 5 grams. The putter 100-1 can be adjusted for weight, for example, up to 20 grams to provide a desired feel or stabilization to the golfer. In some embodiments, the same wrench can be used to adjust the lie angle, the hosel offset and the weight.

Figure 22:
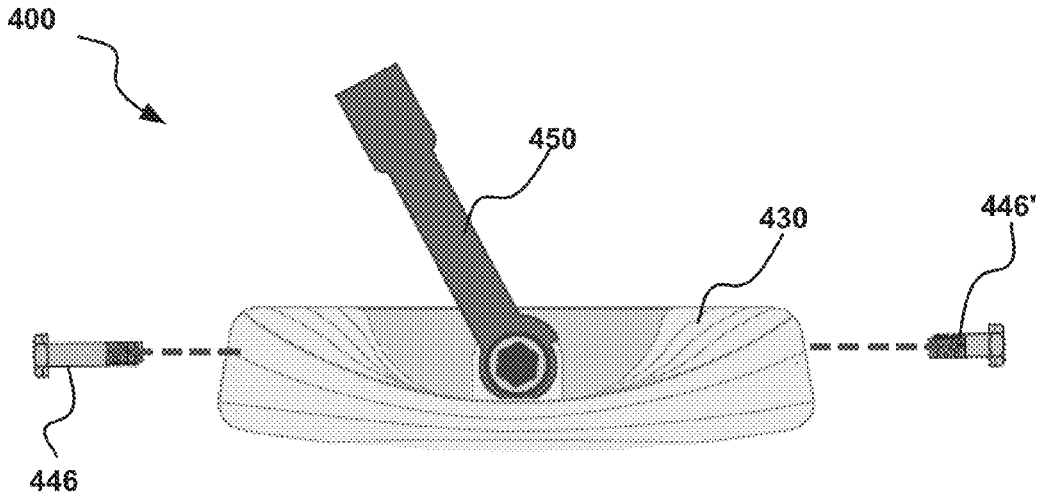
FIG. 22 is a rear view and FIG. 23 is a side view of an adjustable putter according to another embodiment illustrating weight adjustability of the putter.
Figure 23:
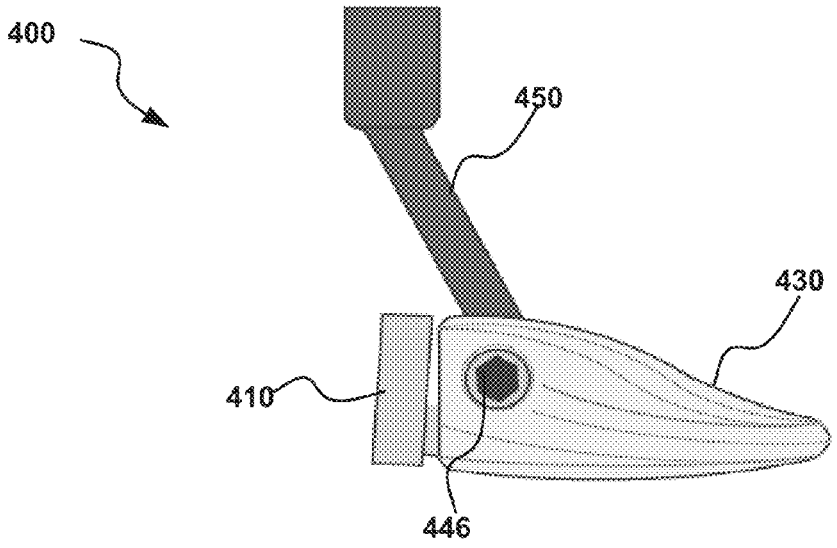

FIGS. 22 and 23 illustrate another example of adjusting the weight of an adjustable putter 400. The adjustable putter 400 can include the same as or similar features and/or functions as putter 100-1 or 100-2 described above. For example, the adjustable putter 400 can include a club body 430, a hosel 450 and a face 410. In this embodiment, weighting screws or bolts 446, 446' can be inserted into weighting ports defined in the body 430 on side portions of the body 430. As with the previous embodiment, weighting bolts 446 can weigh, for example, 10 grams and weighting bolts 446' can weigh, for example 5 grams. It should be understood however, that weighting bolts can be used having different weights. In addition, one or more of the same or different weight bolts can be used to adjust the weight of the putter.

Figure 24:
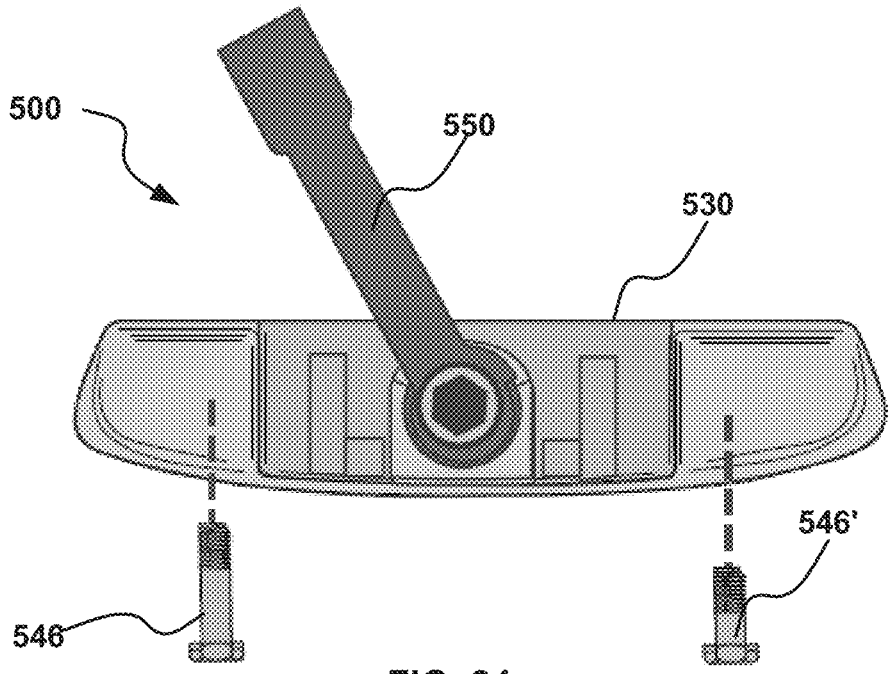
FIG. 24 is a rear view and FIG. 25 is a bottom view of an adjustable putter according to another embodiment illustrating weight adjustability of the putter.
Figure 25:
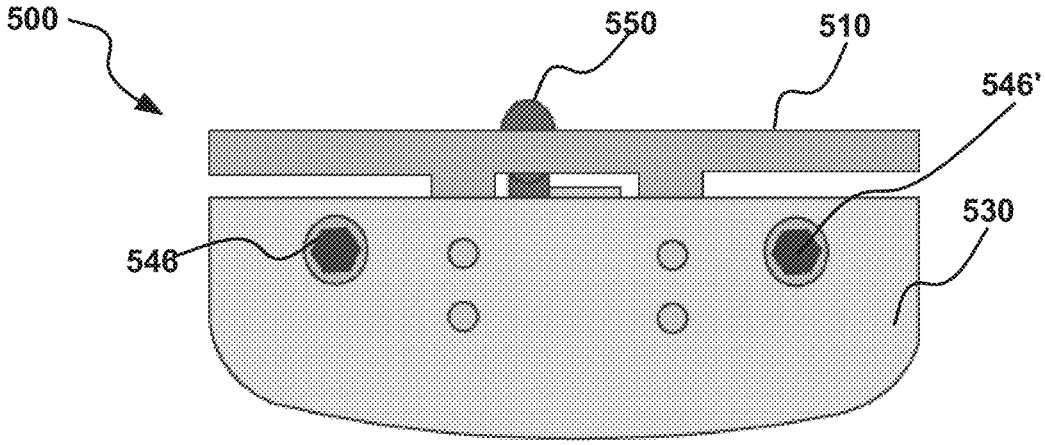
Figure 26:
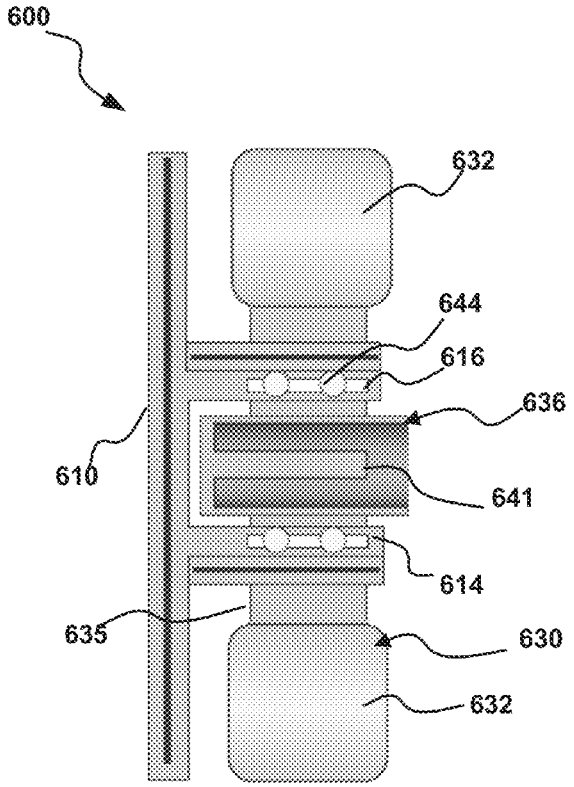
FIG. 26 is a top view and FIG. 27 is a bottom view of a head assembly of an adjustable putter according to another embodiment.
Figure 27:
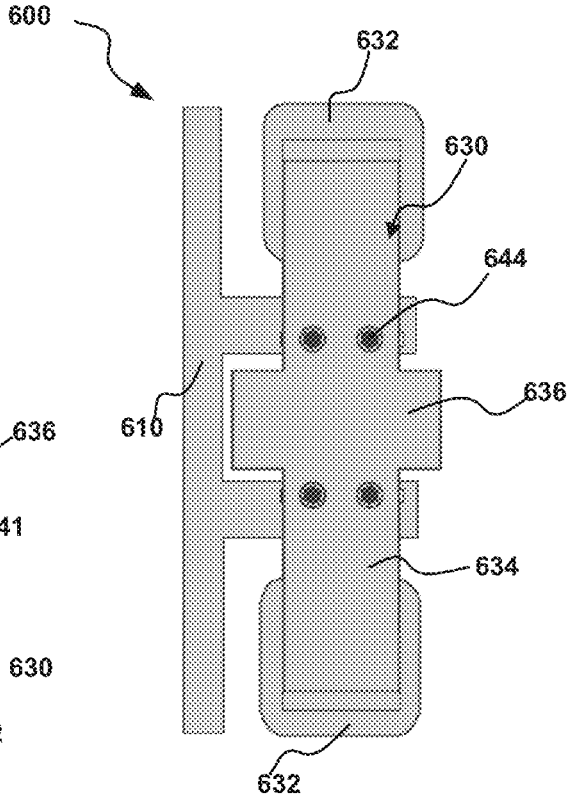
Figure 28:
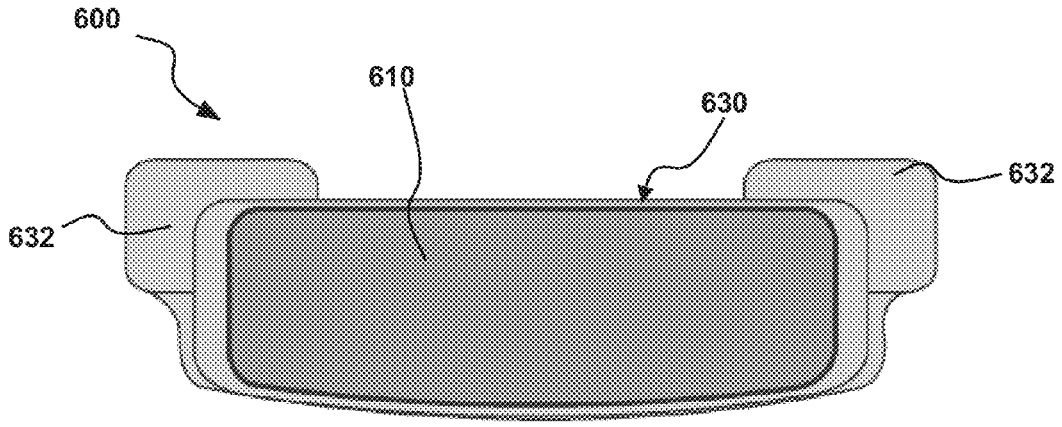
FIG. 28 is a front view and FIG. 29 is a rear view of the head assembly of the adjustable putter of FIGS. 26 and 27.

FIGS. 24 and 25 illustrate another example of adjusting the weight of an adjustable putter 500. The adjustable putter 300 can include the same as or similar features and/or functions as putter 100-1 or 100-2 described above. For, example, the adjustable putter 500 can include a club body 530, a hosel 550 and a face 510. In this embodiment, weighting screws or bolts 546, 546' can be inserted into weighting ports defined in a bottom portion of the body 530.

Figure 29:
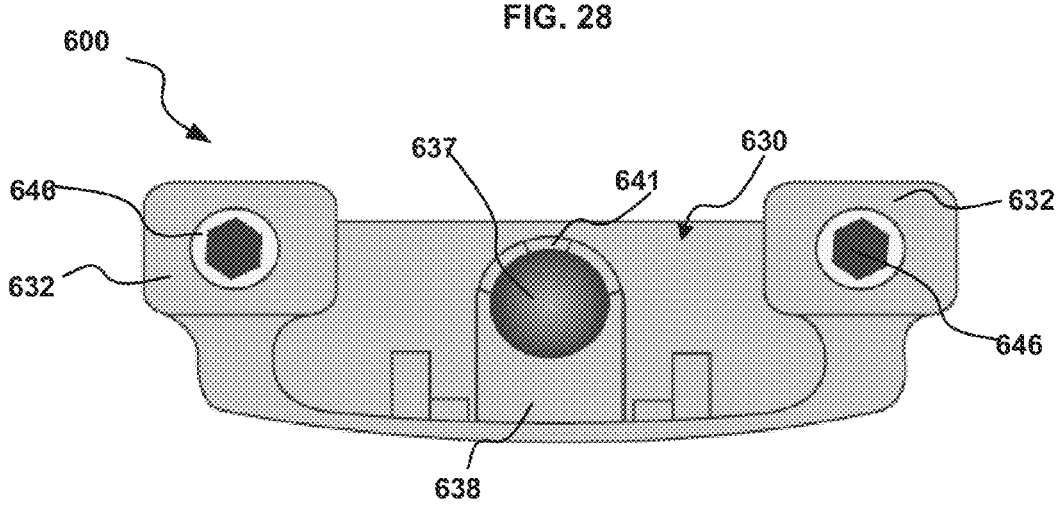
Figure 30:
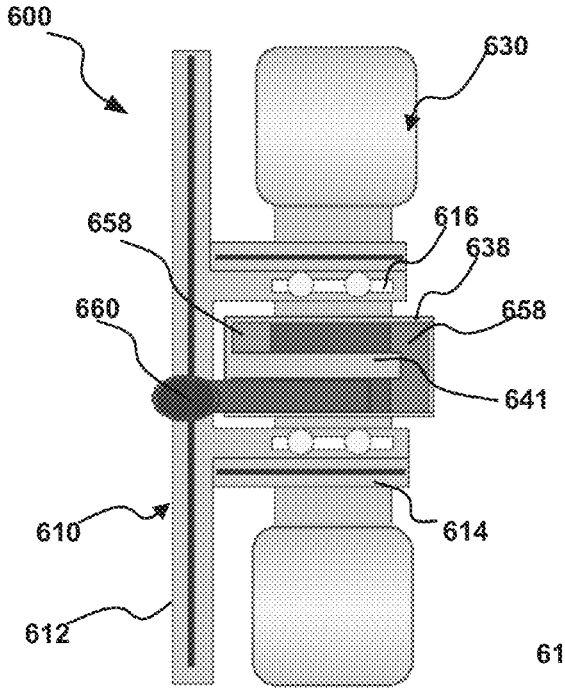
FIGS. 30-32 are a top view, side view and rear view, respectively, of the head assembly of FIGS. 26-29 and a hosel.
Figure 31:
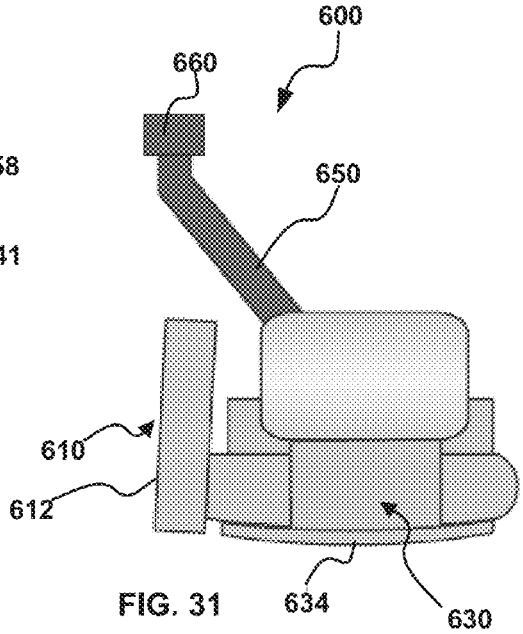
Figure 32:
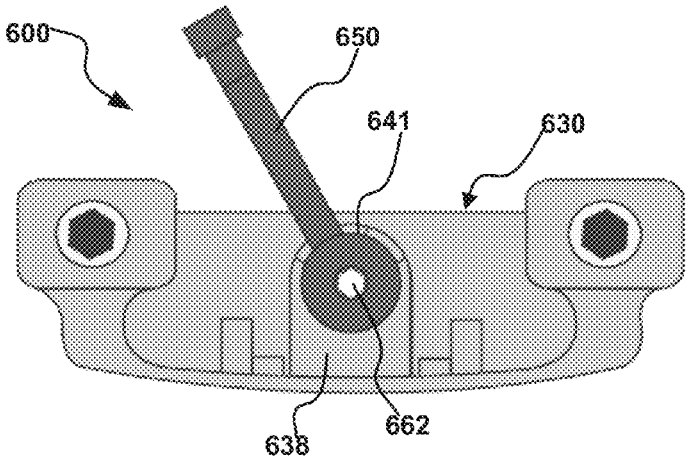

FIGS. 26-32 illustrate a portion of an adjustable putter according to another embodiment. FIGS. 26-39 illustrate a head assembly of the adjustable putter and FIGS. 30-32 illustrate the head assembly and a hosel. An adjustable putter 600 can include any of the components, features and functions of previous embodiments. The adjustable putter 600 includes a head assembly that includes a face unit 610 (also referred to as "face"), a body 630 and a hosel 650. The adjustable putter 600 also includes a shaft (not shown) that can be coupled to a shaft adapter 660 of the hosel 650 (see e.g., FIGS. 31 and 32).

The face unit 610 defines a substantially planar face 612. The face unit 610 includes two alignment rails 614 (see FIGS. 26 and 31). The alignment rails 614 define screw slots 616 that allow screws or other body fasteners 644 to couple the face unit 610 to the blade body 630. The face unit 610 is coupled to the body 630 via four screws and nuts that feed through the screw slots 616 and into four screw holes in a body sole 634 (see FIG. 31).

The body 630 also includes toe and heel side portions 632, the body sole 634, a body face (FIG. 26), and a hosel housing 636 that defines a hosel chamber 637 (see e.g., FIG. 29). The hosel housing 636 includes a center hosel flange 641. The body 630 is attached to the face unit 610 via four body fasteners 644 (e.g., screws). As with previous embodiments, the body sole 634 of the body 630 can include weight ports configured to accept weighting screws 646 (FIG. 29).

The hosel 650 includes a hosel adapter 654, a neck 652 and a shaft adapter 660. The hosel adapter 654 can be received within the hosel chamber 637 such that the neck 652 is disposed on either side of the center flange 641. For example, the hosel neck 652 can be positioned to accommodate both right and left handed users. A pair of bushings 658 can be coupled to the body 630 as described above for previous embodiments, and a hosel bolt 662 (FIG. 32) can be used to secure the hosel 650 to the body 630. The adjustable putter 600 can also include weight ports and weighted screws as described above for previous embodiments. The adjustable putter 600 can be configured to provide adjustability for weight, lie angle, loft angle, and offset as described above for previous embodiments.

Figures 33A, 33B, 33C:
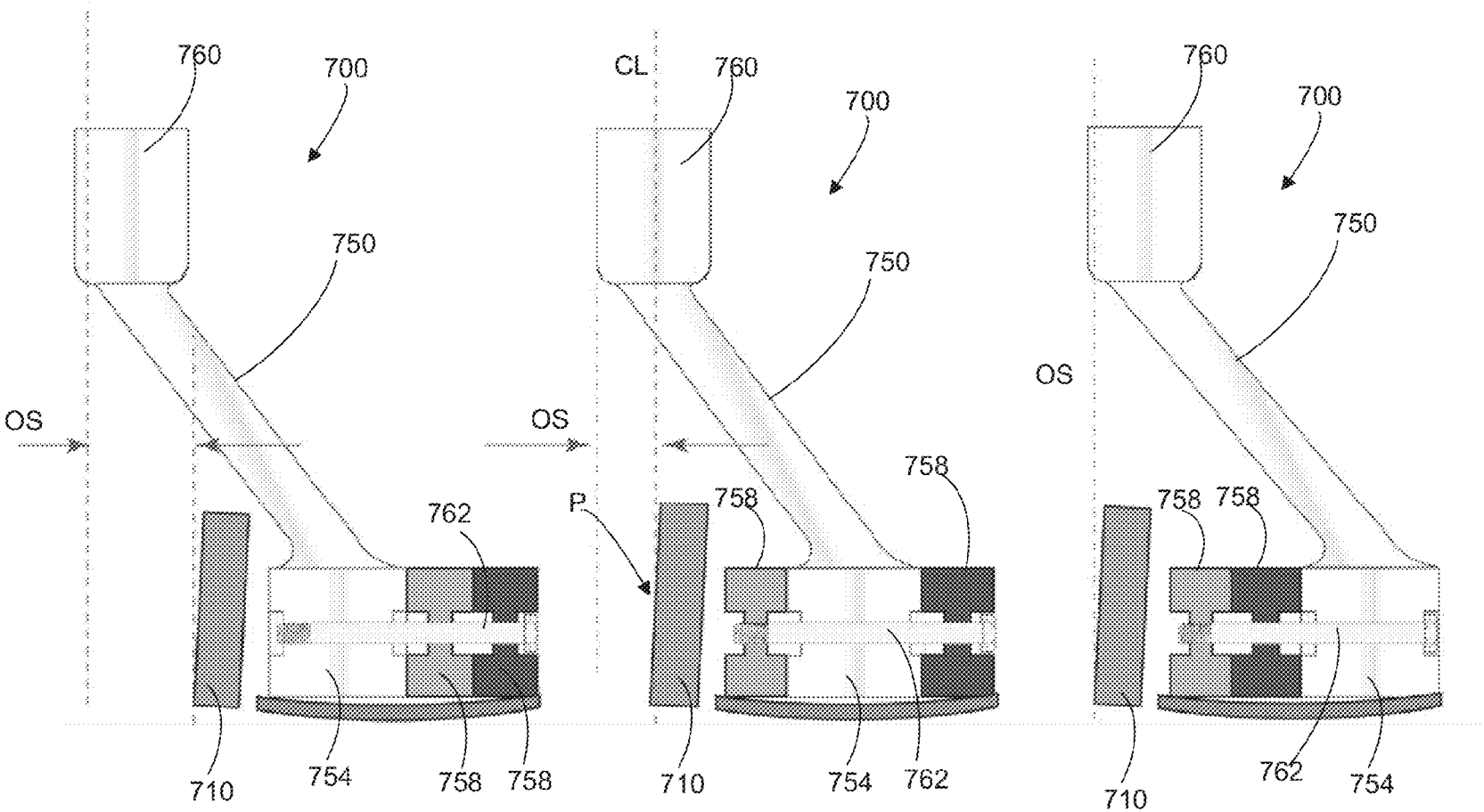
FIGS. 33A-33C are each a schematic illustration of a portion of a putter showing the adjustability of a shaft offset.

FIGS. 33A-33C illustrate a schematic representation of a portion of an adjustable putter to illustrate the adjustability of a shaft offset of the putter. The shaft offset OS is an offset distance of the shaft or a shaft connection portion of the hosel (e.g., shaft adapter 160) relative to the face of the putter, as shown in FIGS. 33A-33C. The shaft offset can be adjusted by changing relative positions of the hosel and the bushings along an axis substantially perpendicular to a plane parallel to a plane of the planar face of the putter.

As shown in FIGS. 33A-33C, a putter 700 includes a club body (not shown), a hosel 750, bushings 758, a face 710, and a hosel bolt 762. The hosel 750 includes a mounting portion 754 and a shaft adapter 760. Although not shown, the putter 700 can also include the same or similar components, and provide similar or the same functions, as described above for previous embodiments, such as shown and described for putter 100-1 and/or putter 100-2.

FIG. 25A illustrates the putter 750 with a "full shaft" offset OS. In this configuration, the shaft adapter 760 (and shaft) is positioned forward of the face 710. To achieve this configuration, the hosel adapter 754 is coupled to the club body forward of the two bushings 758. FIG. 25B illustrates the putter 700 with a "half shaft" offset OS. In this configuration, the face 710 is positioned in alignment with a centerline CL of the shaft adapter 760 of the hosel 750. For example, a location P on the front surface of the face 710 is aligned with or within the same plane as a plane corresponding to the centerline CL of the shaft adapter 760. To achieve this configuration, the hosel adapter 754 is coupled to the club body between the two bushings 758.

FIG. 25C illustrates the putter 700 with a "zero" offset OS. In this configuration, there is no offset and no progression of the face 710 forward of the shaft adapter 760 of the hosel 750. To achieve this configuration, the two bushings 758 are disposed forward of the hosel adapter 754 of the hosel 750. Although the putter 700 illustrates the shaft offset adjustability using two bushings 758 that are the same, additional configurations (shaft offset settings) can be achieved using more than two bushings 758 and/or using bushings that are not the same.

Although some of the embodiments of an adjustable putter described above describe the adjustability of a particular parameter, it should be understood that each of the adjustable putters 100-1, 100-2, 200, 300, 400, 500, 600 and 700 described above can be configured to adjust one or more parameters of the putter, such as, for example, the weight, lie angle, loft angle and/or shaft offset of the putter, as described above. Thus, it should be understood that the same features and functions of embodiments described above can apply to other embodiments of an adjustable putter described herein.

In some embodiments, each of the face unit (e.g., 110, 210, 310, etc.), the body (e.g., 130, 230, 330, etc.) and the hosel (e.g., 150, 250, 350, etc.) can be manufactured, for example, using CNC (Computer numerically controlled) machining. In some embodiments, each of the face unit, the club body and the hosel can be molded.

The hosel (e.g., 150, 250, 350, etc.) can be, for example, investment cast stainless steel. The mallet body (e.g., 130-2, 330) can be, for example, die cast aluminum. The blade body (e.g., 130-1, 230) can be, for example, investment cast stainless steel. The face can be, for example, investment cast stainless steel. The bushings (e.g., 158) can be made of, for example, a polyurethane or aluminum. In some embodiments, thinner bushings can be made of aluminum rather than polyurethane to help reduce the tendency of thinner polyurethane bushings from buckling.

In conclusion, the teachings disclosed herein provide, among other things, an adjustable putter configured to be adapted to vary one or more features including an adjustable lie angle of a hosel neck, an adjustable offset distance of a shaft relative to a face of the putter, and a loft angle of the face. Those skilled in the art can readily recognize that numerous variations and substitutions may be made to the adjustable putters, their use and configuration to achieve substantially the same results as achieved by the embodiments described herein. Accordingly, there is no intention to limit the claims to the disclosed exemplary forms. Many variations, modifications and alternative constructions fall within the scope and spirit of the disclosure as expressed in the claims.

While various embodiments have been described above, it should be understood that they have been presented by way of example only, and not limitation. For example, although some embodiments describe a putter, in other embodiments any golf club can include features described herein. Furthermore, although various embodiments have been described as having particular features and/or combinations of components, other embodiments are possible having a combination of any features and/or components from any of embodiments where appropriate as well as additional features and/or components. For example, although some embodiments describe a golf club with a particular adjustable parameter such as, for example, lie angle and/or loft angle, a golf club can incorporate both an adjustable lie angle and an adjustable loft angle as well as other adjustments such as, for example, weight, hosel offset, etc., as described herein.

What is claimed is:

1. An adjustable golf club head comprising:

a face unit including a face on a front side thereof and at least one guide rail extending in a rearward direction opposite the face and substantially perpendicular to the face;

a hosel comprising:

a hosel neck, and a hosel adapter coupled to the hosel neck, the hosel adapter defining an interior channel;

at least one bushing, the at least one bushing defining an interior channel;

a club body comprising:

a heel portion, a toe portion opposite the heel portion, a sole portion connecting the toe and heel portions, a hosel housing coupled to an upper surface of the sole portion, the hosel housing defining a hosel chamber configured to accept the hosel adapter and the at least one bushing, the hosel housing further defining a housing face on a front side of the hosel housing, and a housing column coupled to a back side of the housing face, the housing column at least partially contained within the hosel chamber, the housing column being configured to be accepted into the interior channels of the hosel adapter and the at least one bushing to couple the hosel, the at least one bushing and the club body; wherein the guide rail and the sole portion of the club body are configured to be coupled via one or more fasteners at a plurality of relative positions to adjust a loft angle of the face of the face unit, the hosel adapter is configured to rotate about the housing column to adjust a lie angle of the hosel neck, and relative positions, on the housing column, of the at least one bushing and the hosel adapter are reconfigurable to adjust an offset of the hosel relative to the face of the face unit.

2. An adjustable golf club head comprising:

a hosel comprising:

a hosel neck, and a hosel adapter coupled to the hosel neck, the hosel adapter defining an interior channel;

a club body comprising:

a heel portion, a toe portion opposite the heel portion, a sole portion connecting the toe and heel portions, a hosel housing coupled to an upper surface of the sole portion, the hosel housing defining a hosel chamber configured to accept the hosel adapter, the hosel housing further defining a housing face on a front side of the hosel housing, and a housing column coupled to a back side of the housing face, the housing column at least partially contained within the hosel chamber, the housing column being configured to be accepted into the interior channel of the hosel adapter to couple the hosel and the club body;

a face unit including a face on a front side thereof and at least one guide rail extending in a rearward direction opposite the face and substantially perpendicular to the face;

wherein the guide rail and the sole portion of the club body are configured to be coupled via one or more fasteners at a plurality of relative positions to adjust a loft of the face of the face unit; wherein the hosel adapter is configured to rotate about the housing column to adjust a lie angle of the hosel neck and the hosel housing is configured to prevent rotation the hosel adapter to keep the lie angle of the hosel neck below a maximum value.

3. An adjustable golf club head comprising:

a hosel comprising:

a hosel neck, and a hosel adapter coupled to the hosel neck, the hosel adapter defining an interior channel;

at least one bushing;

a club body comprising:

a heel portion, a toe portion opposite the heel portion, a sole portion connecting the toe and heel portions, a hosel housing coupled to an upper surface of the sole portion, the hosel housing defining a hosel chamber configured to accept the hosel adapter and the at least one bushing, the hosel housing further defining a housing face on a front side of the hosel housing, a housing column coupled to a back side of the housing face, the housing column at least partially contained within the hosel chamber, the housing column being configured to be accepted into the interior channel of the hosel adapter and the at least one bushing to couple the hosel, the at least one bushing and the club body; and a face unit including a face on a front side thereof and at least one guide rail extending in a rearward direction opposite the face and substantially perpendicular to the face;

wherein the guide rail and the sole portion of the club body are configured to be coupled via one or more fasteners at a plurality of relative positions to adjust a loft of the face of the face unit and wherein relative positions, on the housing column, of the at least one bushing and the hosel adapter are reconfigurable to adjust an offset of the hosel relative to the housing face.

4. An adjustable golf club head, comprising:

a face unit defining a substantially planar face for striking a golf ball and at least one guide rail extending in a rearward direction opposite the face, the guide rail having a convex surface characterized by a radius of rotation about an axis substantially parallel to a plane of the face; and a club body including a sole portion having a concave surface configured to receive the convex surface of the at least one guide rail;

wherein a loft angle of the face unit is adjusted by translating the guide rail relative to the sole portion.

5. The adjustable golf club head of claim 4, further including:

a hosel including a hosel neck and a hosel adapter configured to be received within a hosel chamber defined by the club body;

wherein the hosel adapter is configured to rotate about a longitudinal axis of the hosel chamber so as to adjust a lie angle of the hosel neck.

6. The adjustable golf club head of claim 5, wherein the hosel chamber is configured to prevent rotation the hosel adapter from increasing the lie angle beyond a predetermined value.

7. An adjustable golf club head comprising:

a face unit including a face on a front side thereof and at least one guide rail extending in a rearward direction opposite the face and substantially perpendicular to the face, the guide rail having a downward facing convex surface, the convex surface being characterized by a radius of rotation about an axis parallel to the face;

a club body comprising:

a heel portion, a toe portion opposite the heel portion, and a sole portion connecting the toe and heel portions, the sole portion having an upper surface characterized by an upward facing concave surface configured to receive the downward facing convex surface of the at least one guide rail; wherein the guide rail and the sole portion of the club body are configured to be coupled via one or more fasteners at a plurality of relative positions in a direction perpendicular to the face to adjust a loft angle of the face of the face unit.

8. The adjustable club head of claim 7, further comprising:

a hosel comprising;

a hosel neck, and a hosel adapter coupled to the hosel neck, the hosel adapter defining an interior channel;

wherein the club body further comprises:

a hosel housing coupled to an upper surface of the sole portion, the hosel housing defining a hosel chamber configured to accept the hosel adapter, the hosel housing further defining a housing face on a front side of the hosel housing, and a housing column coupled to a back side of the housing face, the housing column at least partially contained within the hosel chamber, the housing column being configured to be accepted into the interior channel of the hosel adapter to couple the hosel and the club body; wherein the hosel adapter is configured to rotate about the housing column to adjust a lie angle of the hosel neck.

9. The adjustable club head of claim 7, further comprising:

at least one bushing, the at least one bushing defining an interior channel;

wherein the hosel chamber is further configured to accept the at least one bushing and the housing column is further configured to be accepted into the interior channel of the at least one bushing, and further wherein relative positions, on the housing column, of the at least one bushing and the hosel adapter are reconfigurable to adjust an offset of the hosel relative to the face of the face unit.

10. An adjustable golf club, comprising:

a golf club head defining a substantially planar face for striking a golf ball;

a hosel including a hosel adapter configured to be received within a hosel chamber defined by the golf club head; and a shaft attachable to the hosel wherein an offset distance of the shaft relative to the substantially planar face is adjustable and wherein the hosel adapter is able to be received and positioned within the hosel chamber only at a plurality of predetermined positions separated by predetermined distances so as to provide a corresponding plurality of offset distances;

wherein the golf club head is characterized by a loft angle of the face, a lie angle of the hosel and a weight wherein the golf club head is configured to enable adjustment of the loft angle, the lie angle and the weight;

wherein adjustment of the loft angle by movement of the substantially planar face to a new orientation on the head does not affect a position of the hosel or the shaft.

11. The adjustable golf club of claim 10 wherein the golf club head comprises a putter head and wherein the offset distance is adjustable to at least two predetermined configurations.

12. The adjustable golf club of claim 11 wherein the at least two predetermined configurations include a minimum offset configuration, a zero offset configuration, and a face progression offset configuration.

13. The adjustable golf club of claim 10 wherein the golf club head comprises a putter head and wherein the hosel further includes a hosel neck, the adjustable golf club further comprising a housing column wherein the hosel adapter is configured to rotate about the housing column so as to adjust a lie angle of the hosel neck and wherein the hosel chamber is configured to prevent rotation of the hosel adapter from increasing the lie angle beyond a predetermined value.

14. The adjustable golf club of claim 10 wherein the golf club head comprises a putter head and wherein the adjustable golf club further includes at least one bushing being receivable within the hosel chamber, the offset distance being adjusted to ones of the plurality of offset distances by changing relative positions of the hosel adapter and the at least one bushing along an axis substantially perpendicular to a plane parallel to a plane of the planar face.

15. The adjustable golf club of claim 14, further including an additional bushing receivable within the hosel chamber wherein the offset distance is further adjustable by changing a position of the additional bushing relative to at least one of the hosel adapter and the at least one bushing along the axis.

16. The adjustable golf club of claim 14 wherein ones of the predetermined distances are defined by a dimension of the at least one bushing.

17. The adjustable golf club of claim 10 wherein adjustment of the lie angle does not affect the offset distance.

18. The adjustable golf club of claim 10 wherein the movement of the substantially planar face is in a forward and rearward direction generally perpendicular to the face.

19. An adjustable golf club, comprising:

a golf club head having a face and defining a hosel chamber;

a hosel coupled to the golf club head;

a shaft; and a hosel adapter configured to attach the shaft to the golf club head wherein the hosel adapter is able to be received and positioned within the hosel chamber only at a plurality of predetermined positions wherein the predetermined positions are separated by predetermined distances;

wherein the adjustable golf club is characterized by a loft angle of the face, a lie angle of the hosel and a weight and is configured to enable adjustment of at least the loft angle, the lie angle, and an offset distance of the shaft relative to the face of the golf club head;

wherein the offset distance is adjusted by moving the hosel adapter to different ones of the plurality of predetermined positions and wherein the loft angle is adjusted by moving the face to a new orientation on the head.

20. The adjustable golf club of claim 19 wherein the golf club head comprises a putter head and wherein the offset distance is adjustable to at least two predetermined configurations.

21. The adjustable golf club of claim 20 wherein the at least two predetermined configurations include a minimum offset configuration, a zero offset configuration, and a face progression offset configuration.

22. The adjustable golf club of claim 19 wherein the golf club head comprises a putter head and wherein the hosel includes one or more hosel flanges configured to limit the lie angle to a predetermined range.

23. The adjustable golf club of claim 22 wherein the predetermined range is from 58° to 79°.

24. The adjustable golf club of claim 19 wherein adjustment of the loft angle does not affect a position of the hosel or the shaft.

25. The adjustable golf club of claim 19 wherein the golf club head comprises a putter head and wherein the adjustable golf club further includes at least one bushing being receivable within the hosel chamber defined by the putter head, the offset distance being adjusted by changing relative positions of the hosel adapter and the at least one bushing along an axis substantially perpendicular to a plane parallel to a plane of the planar face.

26. The adjustable golf club of claim 19 wherein adjustment of the lie angle does not affect the offset distance.

27. The adjustable golf club of claim 19 wherein the face is defined by a face unit and wherein the loft is adjusted by moving the face unit in a forward and rearward direction generally perpendicular to the face.

* * * * *